US009804550B2

(12) United States Patent
Hoshino

(10) Patent No.: US 9,804,550 B2
(45) Date of Patent: Oct. 31, 2017

(54) IMAGE FORMATION APPARATUS

(71) Applicant: Oki Data Corporation, Tokyo (JP)

(72) Inventor: Masahiko Hoshino, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1 day.

(21) Appl. No.: 14/658,447

(22) Filed: Mar. 16, 2015

(65) Prior Publication Data

US 2015/0261165 A1 Sep. 17, 2015

(30) Foreign Application Priority Data

Mar. 17, 2014 (JP) ..... 2014-053358

(51) Int. Cl.
*G03G 15/00* (2006.01)
*G03G 9/087* (2006.01)

(52) U.S. Cl.
CPC ..... *G03G 15/6585* (2013.01); *G03G 15/6582* (2013.01); *G03G 9/08797* (2013.01)

(58) Field of Classification Search
CPC ..... G03G 15/6585; G03G 2215/207; G03G 2215/2074
See application file for complete search history.

(56) References Cited

U.S. PATENT DOCUMENTS

2008/0108501 A1* 5/2008 Fujimoto et al. ..... 503/227
2009/0034998 A1* 2/2009 Omata ..... G03G 15/657 399/45
2012/0063819 A1* 3/2012 Kasai et al. ..... 399/298
2012/0196224 A1* 8/2012 Fowlkes ..... 430/124.1
2014/0255053 A1* 9/2014 Ohshika ..... 399/53

FOREIGN PATENT DOCUMENTS

JP 2007114499 A * 5/2007
JP 2010048921 A * 3/2010
JP 2012-42882 A 3/2012

* cited by examiner

*Primary Examiner* — R. A. Smith
*Assistant Examiner* — John M Royston
(74) *Attorney, Agent, or Firm* — Metrolexis Law Group, PLLC

(57) ABSTRACT

An image formation apparatus includes a transfer unit configured to transfer a second material with different solubility from that of a first material to a second position of a print medium where the second material comes into contact with the first material in a first position of the print medium, and a fixation unit configured to melt the second material transferred to the second position of the print medium, and fix the second material to the print medium.

8 Claims, 13 Drawing Sheets

VIEW (1) OF FIRST EVALUATION PATTERN FORMED WITH BASIC COLOR TONERS AND CLEAR TONER ON SURFACE OF PLAIN PAPER

Fig.2 CIRCUIT CONFIGURATION OF COLOR PRINTER

CIRCUIT CONFIGURATIONS OF DEVELOPMENT CONTROLLER AND DEVELOPMENT UNIT

Fig.4 CIRCUIT CONFIGURATIONS OF CHARGE CONTROLLER AND CHARGE UNIT
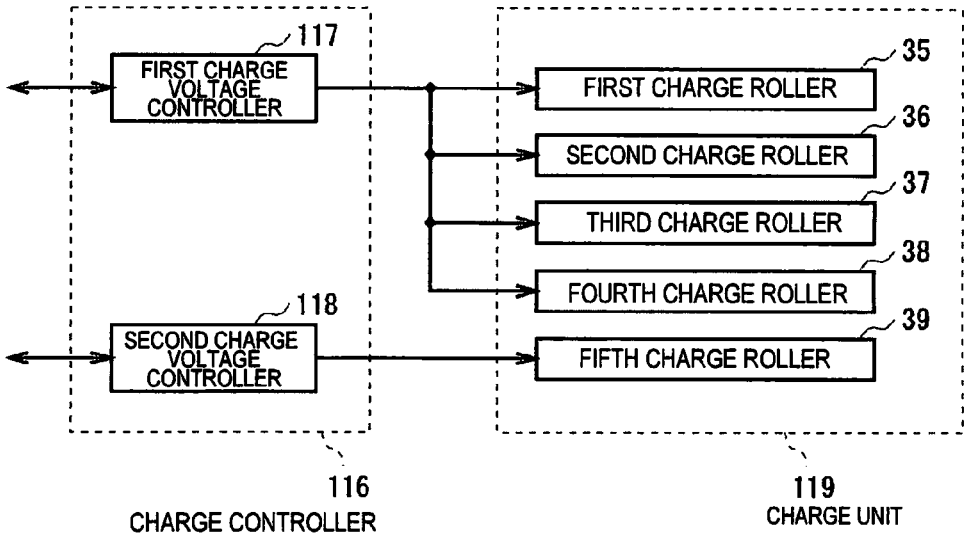
Fig.5 CIRCUIT CONFIGURATIONS OF EXPOSURE CONTROLLER AND EXPOSURE UNIT
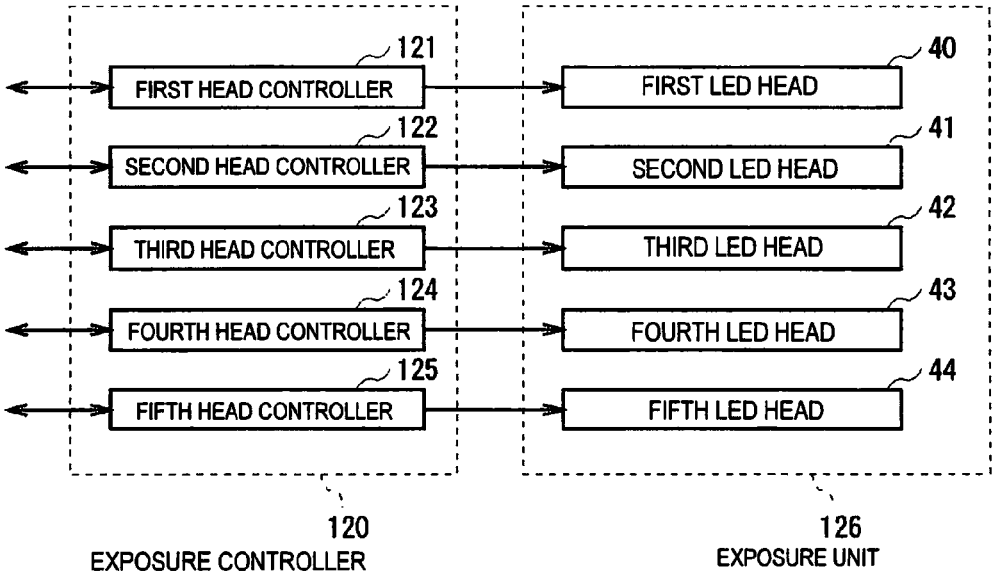

Fig.6 CIRCUIT CONFIGURATIONS OF TRANSFER CONTROLLER AND TRANSFER UNIT
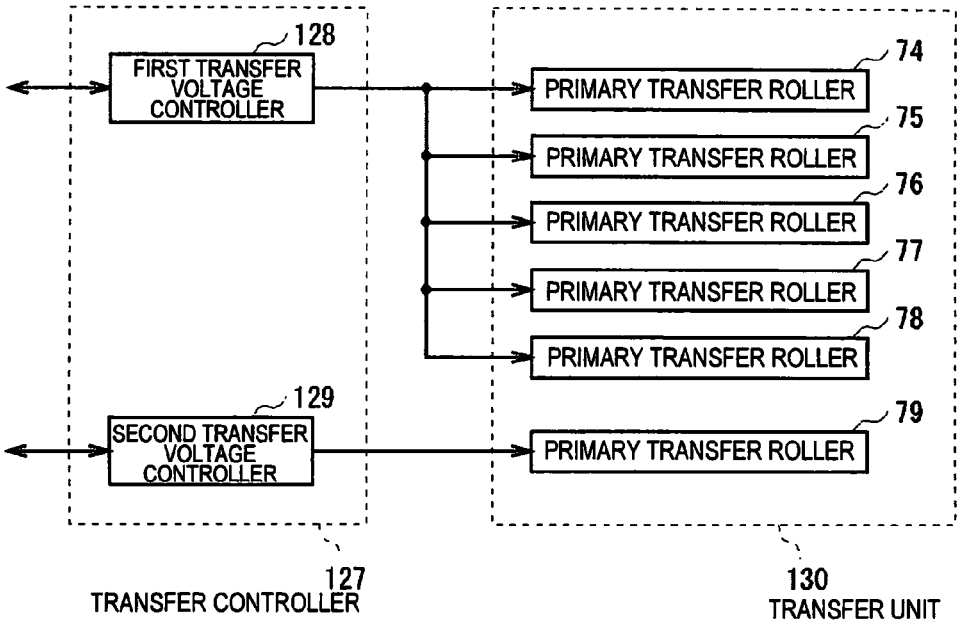
Fig.7
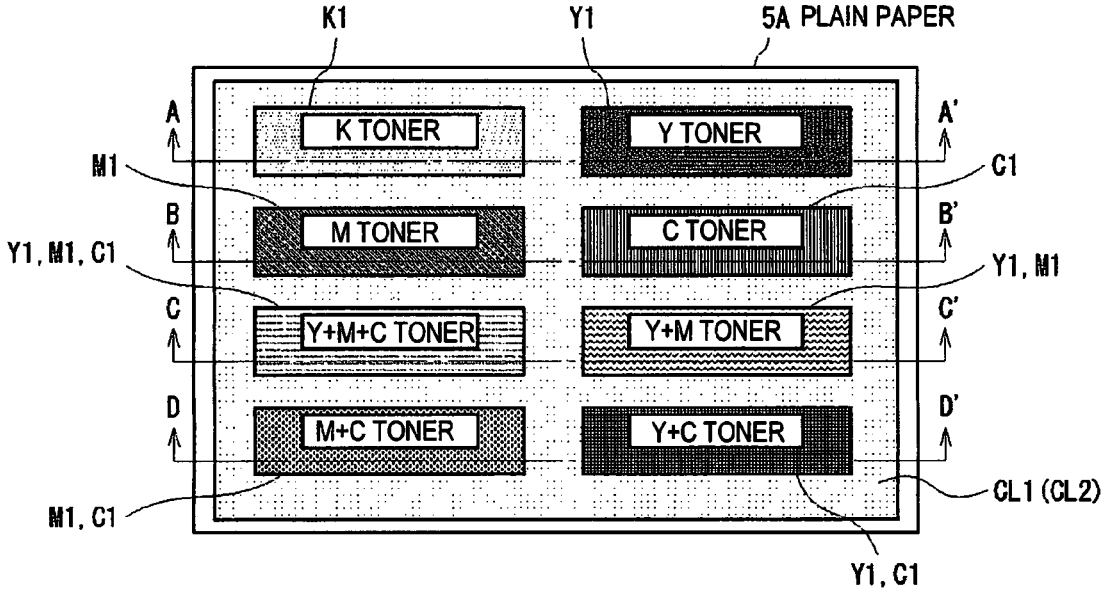
VIEW (1) OF FIRST EVALUATION PATTERN FORMED WITH BASIC COLOR TONERS AND CLEAR TONER ON SURFACE OF PLAIN PAPER VIEW (2) OF FIRST EVALUATION PATTERN FORMED WITH BASIC COLOR TONERS AND CLEAR TONER ON SURFACE OF PLAIN PAPER

Fig. 9

RESULTS (1) OF EVALUATION TEST ACCORDING TO FIRST EMBODIMENT

| | SOLUBILITY PARAMETER [(cal/cm³)^1/2] | | | | | | | | | | HEAT PRESSING CONDITIONS | | FIRST EVALUATION | SECOND EVALUATION | COMPREHENSIVE EVALUATION |
|---|---|---|---|---|---|---|---|---|---|---|---|---|---|---|---|
| | BASIC COLOR TONERS | | | | | | | | CLEAR TONERS | | TEMPERATURE [°C] | NIP PRESSURE [kg/cm²] | | | |
| FIRST PATTERN FORMATION CONDITIONS | K1 | 16.2 | Y1 | 16.4 | M1 | 16.5 | C1 | 16.8 | CL2 | 16.1 | 150 | 2.5 | ○ | × | × |
| | | | | | | | | | CL1 | 10.1 | | 1.5 | ○ | × | × |
| | | | | | | | | | | | | 2.0 | ○ | × | × |
| | | | | | | | | | | | | 2.5 | ○ | × | × |
| | | | | | | | | | | | | 3.0 | ○ | × | × |
| | | | | | | | | | | | | 3.5 | ○ | × | × |
| | | | | | | | | | | | | 4.0 | ○ | × | × |
| SECOND PATTERN FORMATION CONDITIONS | K1 | 16.2 | Y1 | 16.4 | M1 | 16.5 | C1 | 16.8 | CL2 | 16.1 | 160 | 2.5 | × | × | × |
| | | | | | | | | | CL1 | 10.1 | | 1.5 | ○ | × | × |
| | | | | | | | | | | | | 2.0 | ○ | ○ | ○ |
| | | | | | | | | | | | | 2.5 | ○ | ○ | ○ |
| | | | | | | | | | | | | 3.0 | ○ | ○ | ○ |
| | | | | | | | | | | | | 3.5 | ○ | ○ | ○ |
| | | | | | | | | | | | | 4.0 | ○ | × | × |
| THIRD PATTERN FORMATION CONDITIONS | K1 | 16.2 | Y1 | 16.4 | M1 | 16.5 | C1 | 16.8 | CL2 | 16.1 | 170 | 2.5 | × | ○ | × |
| | | | | | | | | | CL1 | 10.1 | | 1.5 | ○ | × | × |
| | | | | | | | | | | | | 2.0 | ○ | ○ | ○ |
| | | | | | | | | | | | | 2.5 | ○ | ○ | ○ |
| | | | | | | | | | | | | 3.0 | ○ | ○ | ○ |
| | | | | | | | | | | | | 3.5 | ○ | ○ | ○ |
| | | | | | | | | | | | | 4.0 | ○ | × | × |

Fig. 10

RESULTS (2) OF EVALUATION TEST ACCORDING TO FIRST EMBODIMENT

| | SOLUBILITY PARAMETER [(cal/cm$^3$)$^{1/2}$] | | | | | | | | | | HEAT PRESSING CONDITIONS | | FIRST EVALU-ATION | SECOND EVALU-ATION | COMPRE-HENSIVE EVALU-ATION |
|---|---|---|---|---|---|---|---|---|---|---|---|---|---|---|---|
| | BASIC COLOR TONERS | | | | | | | | CLEAR TONERS | | TEMPE-RATURE [℃] | NIP PRESSURE [kg/cm$^2$] | | | |
| SIXTH PATTERN FORMATION CONDITIONS | K1 | 16.2 | Y1 | 16.4 | M1 | 16.5 | C1 | 16.8 | CL2 | 16.1 | 180 | 2.5 | × | ○ | × |
| | | | | | | | | | CL1 | 10.1 | | 1.5 | ○ | × | × |
| | | | | | | | | | | | | 2.0 | ○ | ○ | ○ |
| | | | | | | | | | | | | 2.5 | ○ | ○ | ○ |
| | | | | | | | | | | | | 3.0 | ○ | ○ | ○ |
| | | | | | | | | | | | | 3.5 | ○ | ○ | ○ |
| | | | | | | | | | | | | 4.0 | ○ | × | × |
| SEVENTH PATTERN FORMATION CONDITIONS | K1 | 16.2 | Y1 | 16.4 | M1 | 16.5 | C1 | 16.8 | CL2 | 16.1 | 190 | 2.5 | × | ○ | × |
| | | | | | | | | | CL1 | 10.1 | | 1.5 | ○ | × | × |
| | | | | | | | | | | | | 2.0 | ○ | ○ | ○ |
| | | | | | | | | | | | | 2.5 | ○ | ○ | ○ |
| | | | | | | | | | | | | 3.0 | ○ | ○ | ○ |
| | | | | | | | | | | | | 3.5 | ○ | × | × |
| | | | | | | | | | | | | 4.0 | ○ | × | × |

Fig. 11

RESULTS (3) OF EVALUATION TEST ACCORDING TO FIRST EMBODIMENT

| | SOLUBILITY PARAMETER [(cal/cm$^3$)$^{1/2}$] | | | | | | | | | | HEAT PRESSING CONDITIONS | | FIRST EVALUATION | SECOND EVALUATION | COMPREHENSIVE EVALUATION |
|---|---|---|---|---|---|---|---|---|---|---|---|---|---|---|---|
| | BASIC COLOR TONERS | | | | | | | | CLEAR TONERS | | TEMPERATURE [℃] | NIP PRESSURE [kg/cm$^2$] | | | |
| SIXTH PATTERN FORMATION CONDITIONS | K1 | 16.2 | Y1 | 16.4 | M1 | 16.5 | C1 | 16.8 | CL2 | 16.1 | 200 | 2.5 | × | × | × |
| | | | | | | | | | CL1 | 10.1 | | 1.5 | ○ | × | × |
| | | | | | | | | | | | | 2.0 | ○ | ○ | ○ |
| | | | | | | | | | | | | 2.5 | ○ | ○ | ○ |
| | | | | | | | | | | | | 3.0 | ○ | ○ | ○ |
| | | | | | | | | | | | | 3.5 | ○ | × | × |
| | | | | | | | | | | | | 4.0 | ○ | × | × |
| SEVENTH PATTERN FORMATION CONDITIONS | K1 | 16.2 | Y1 | 16.4 | M1 | 16.5 | C1 | 16.8 | CL2 | 16.1 | 210 | 2.5 | × | × | × |
| | | | | | | | | | CL1 | 10.1 | | 1.5 | ○ | × | × |
| | | | | | | | | | | | | 2.0 | ○ | × | × |
| | | | | | | | | | | | | 2.5 | ○ | × | × |
| | | | | | | | | | | | | 3.0 | ○ | × | × |
| | | | | | | | | | | | | 3.5 | ○ | × | × |
| | | | | | | | | | | | | 4.0 | ○ | × | × |

VIEW (1) OF THIRD EVALUATION PATTERN FORMED WITH BASIC COLOR TONERS AND FIRST CLEAR TONER ON SURFACE OF TRANSFER PAPER

VIEW (2) OF THIRD EVALUATION PATTERN FORMED WITH BASIC COLOR TONERS AND FIRST CLEAR TONER ON SURFACE OF TRANSFER PAPER

VIEW (1) OF SECOND EVALUATION PATTERN FORMED WITH BASIC COLOR TONERS ON SURFACE OF TRANSFER PAPER

VIEW (2) OF SECOND EVALUATION PATTERN FORMED WITH BASIC COLOR TONERS ON SURFACE OF TRANSFER PAPER

Fig.16

RESULTS (1) OF EVALUATION TEST ACCORDING TO SECOND EMBODIMENT

| | SOLUBILITY PARAMETER [(cal/cm³)^1/2] | | | | | | | | | | HEAT PRESSING CONDITIONS | | FIRST EVALUATION | SECOND EVALUATION | COMPREHENSIVE EVALUATION |
|---|---|---|---|---|---|---|---|---|---|---|---|---|---|---|---|
| | BASIC COLOR TONERS | | | | | | | | CLEAR TONER | | TEMPERATURE [°C] | NIP PRESSURE [kg/cm²] | | | |
| TENTH PATTERN FORMATION CONDITIONS | K1 | 16.2 | Y1 | 16.4 | M1 | 16.5 | C1 | 16.8 | | – | 160 | 2.0 | × | ○ | × |
| | | | | | | | | | | | | 2.5 | × | ○ | × |
| | | | | | | | | | | | | 3.0 | × | ○ | × |
| | | | | | | | | | CL1 | 10.1 | | 2.0 | ○ | ○ | ○ |
| | | | | | | | | | | | | 2.5 | ○ | ○ | ○ |
| | | | | | | | | | | | | 3.0 | ○ | ○ | ○ |
| ELEVENTH PATTERN FORMATION CONDITIONS | K1 | 16.2 | Y1 | 16.4 | M1 | 16.5 | C1 | 16.8 | | – | 170 | 2.0 | × | ○ | × |
| | | | | | | | | | | | | 2.5 | × | ○ | × |
| | | | | | | | | | | | | 3.0 | × | ○ | × |
| | | | | | | | | | CL1 | 10.1 | | 2.0 | ○ | ○ | ○ |
| | | | | | | | | | | | | 2.5 | ○ | ○ | ○ |
| | | | | | | | | | | | | 3.0 | ○ | ○ | ○ |
| TWELFTH PATTERN FORMATION CONDITIONS | K1 | 16.2 | Y1 | 16.4 | M1 | 16.5 | C1 | 16.8 | | – | 180 | 2.0 | × | ○ | × |
| | | | | | | | | | | | | 2.5 | × | ○ | × |
| | | | | | | | | | | | | 3.0 | × | ○ | × |
| | | | | | | | | | CL1 | 10.1 | | 2.0 | ○ | ○ | ○ |
| | | | | | | | | | | | | 2.5 | ○ | ○ | ○ |
| | | | | | | | | | | | | 3.0 | ○ | ○ | ○ |

Fig.17 RESULTS (2) OF EVALUATION TEST ACCORDING TO SECOND EMBODIMENT

| | SOLUBILITY PARAMETER [(cal/cm³)^1/2] | | | | | | | | | | HEAT PRESSING CONDITIONS | | FIRST EVALUATION | SECOND EVALUATION | COMPREHENSIVE EVALUATION |
|---|---|---|---|---|---|---|---|---|---|---|---|---|---|---|---|
| | BASIC COLOR TONERS | | | | | | | | CLEAR TONER | | TEMPERATURE [°C] | NIP PRESSURE [kg/cm²] | | | |
| THIRTEENTH PATTERN FORMATION CONDITIONS | K1 | 16.2 | Y1 | 16.4 | M1 | 16.5 | C1 | 16.8 | | – | 190 | 2.0 | × | ○ | × |
| | | | | | | | | | | | | 2.5 | × | ○ | × |
| | | | | | | | | | | | | 3.0 | × | ○ | × |
| | | | | | | | | | CL1 | 10.1 | | 2.0 | ○ | ○ | ○ |
| | | | | | | | | | | | | 2.5 | ○ | ○ | ○ |
| | | | | | | | | | | | | 3.0 | ○ | ○ | ○ |
| FOURTEENTH PATTERN FORMATION CONDITIONS | K1 | 16.2 | Y1 | 16.4 | M1 | 16.5 | C1 | 16.8 | | – | 200 | 2.0 | × | ○ | × |
| | | | | | | | | | | | | 2.5 | × | ○ | × |
| | | | | | | | | | | | | 3.0 | × | ○ | × |
| | | | | | | | | | CL1 | 10.1 | | 2.0 | ○ | ○ | ○ |
| | | | | | | | | | | | | 2.5 | ○ | ○ | ○ |
| | | | | | | | | | | | | 3.0 | ○ | ○ | ○ |

IMAGE FORMATION APPARATUS

CROSS REFERENCE TO RELATED APPLICATIONS

This application claims priority based on 35 USC 119 from prior Japanese Patent Application No. 2014-053358 filed on Mar. 17, 2014, entitled "IMAGE FORMATION APPARATUS", the entire contents of which are incorporated herein by reference.

BACKGROUND OF THE INVENTION

1. Field of the Invention

This disclosure relates to an image formation apparatus, for example, a color electrophotographic printer (hereinafter also referred to as a color printer), and one suitably applicable to toner for use in printing with the color printer.

2. Description of Related Art

The conventional color printer, for example, forms toner images of clear, yellow, magenta, cyan, and black in five print engines, sequentially transfers the toner images one on top of another to the surface of an intermediate transfer belt, and then transfers these five color toner images from the surface of the intermediate transfer belt to the surface of a sheet. The color printer then fixes these five color toner images to the surface of the sheet through heating and pressing to form a color print image.

In the conventional color printer, black toner contains carbon, which is easily charged with a polarity opposite to that of the other color toners. For this reason, for some of the linear parts of a black toner image to be covered with a clear toner image, the conventional color printer forms a combination of the other yellow, magenta, and cyan toner images, instead of the black toner image.

In this way, in transferring the black toner image and the other color toner images, one on top of another, to the surface of the intermediate transfer belt or the surface of the sheet, the conventional color printer makes the black toner less likely to be spread around the transfer position due to the repulsion of the black toner away from the other color toners which may cause color blurring in the print image (for example, see Japanese Patent Application Publication No. 2012-42882, pp. 6 to 8 and FIG. 7).

SUMMARY OF THE INVENTION

In the conventional color printer, when the five color toner images transferred on the surface of the sheet are heated and pressed, the melted toners forming the toner images cause color blurring in a print image in some cases. The conventional color printer, however, is not configured to avoid color blurring caused by toner melting, and is incapable of sufficiently preventing deterioration of the image quality of print images due to color blurring.

An object of an embodiment of the invention is to provide an image formation apparatus capable of preventing deterioration of the image quality of print images.

An aspect of the invention is an image formation apparatus that includes: a transfer unit configured to transfer a second material with a different solubility from that of a first material to a second position of a print medium where the second material comes into contact with the first material in a first position of the print medium; and a fixation unit configured to melt the second material transferred to the second position of the print medium, and fix the second material to the print medium.

According to an aspect of the invention, when the second material transferred to the print medium is melted, the melted second material is prevented from being mixed with the first material on the print medium, which can avoid color blurring in the boundary between the second material and the first material.

This can achieve an image formation apparatus capable of preventing deterioration of the image quality of print images.

BRIEF DESCRIPTION OF THE DRAWINGS

FIG. 4 is a block diagram illustrating the circuit configurations of a charge controller and a charge unit;

FIG. 5 is a block diagram illustrating the circuit configurations of an exposure controller and an exposure unit;

FIG. 6 is a block diagram illustrating the circuit configurations of a transfer controller and a transfer unit;

FIG. 7 is a schematic top view provided for the description of the first evaluation pattern (1) formed with basic color toners and a clear toner on the surface of plain paper;

FIG. 9 is a table provided for the description of evaluation test (1) according to the first embodiment;

FIG. 10 is a table provided for the description of evaluation test (2) according to the first embodiment;

FIG. 11 is a table provided for the description of evaluation test (3) according to the first embodiment;

FIG. 16 is a table provided for the description of evaluation test (1) according to the second embodiment; and FIG. 17 is a table provided for the description of evaluation test (2) according to the second embodiment.

DETAILED DESCRIPTION OF EMBODIMENTS

Figure 1:
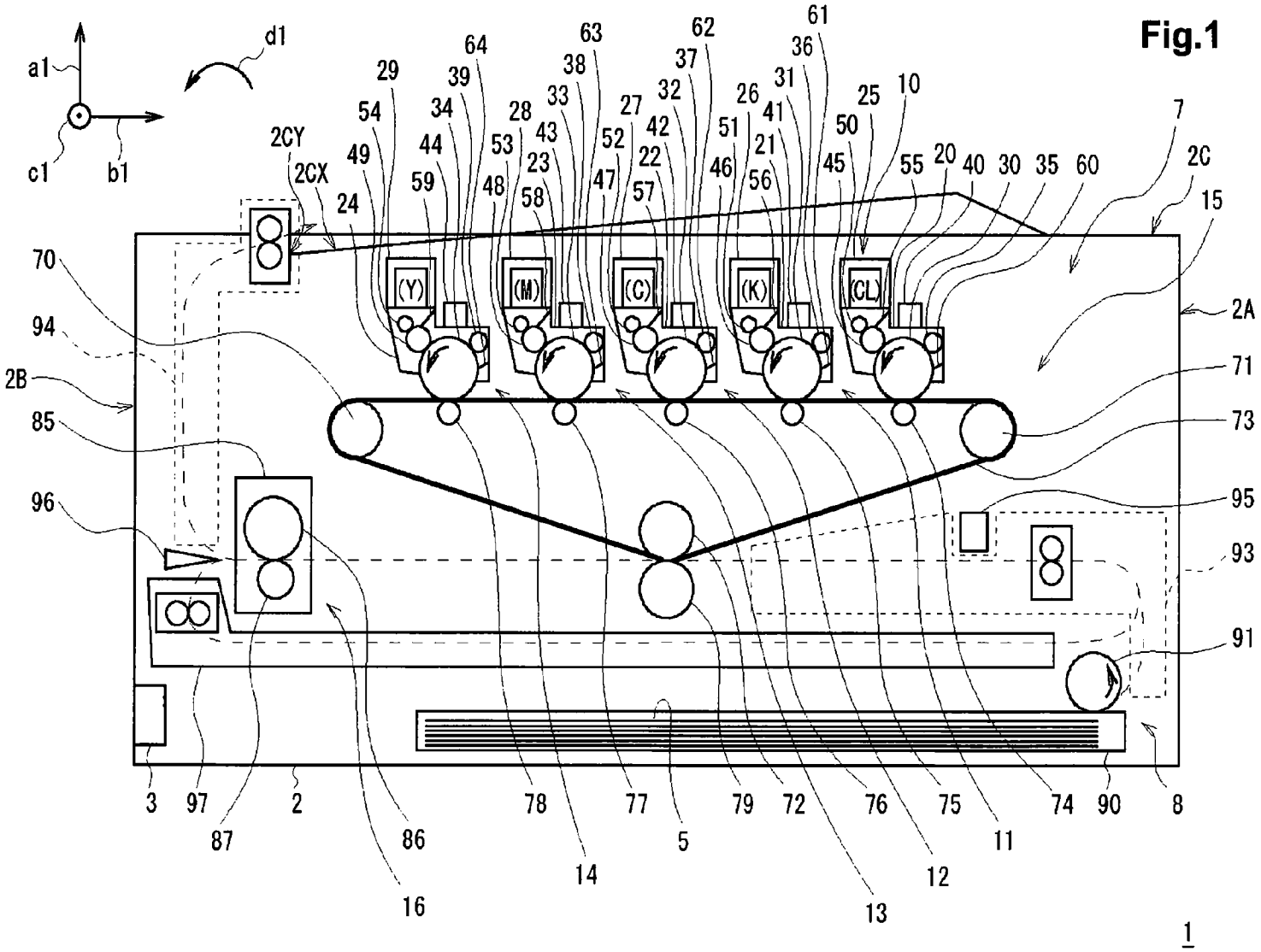
FIG. 1 is a schematic cross-sectional view of the internal configuration of a color printer according to the invention.
Figure 2:
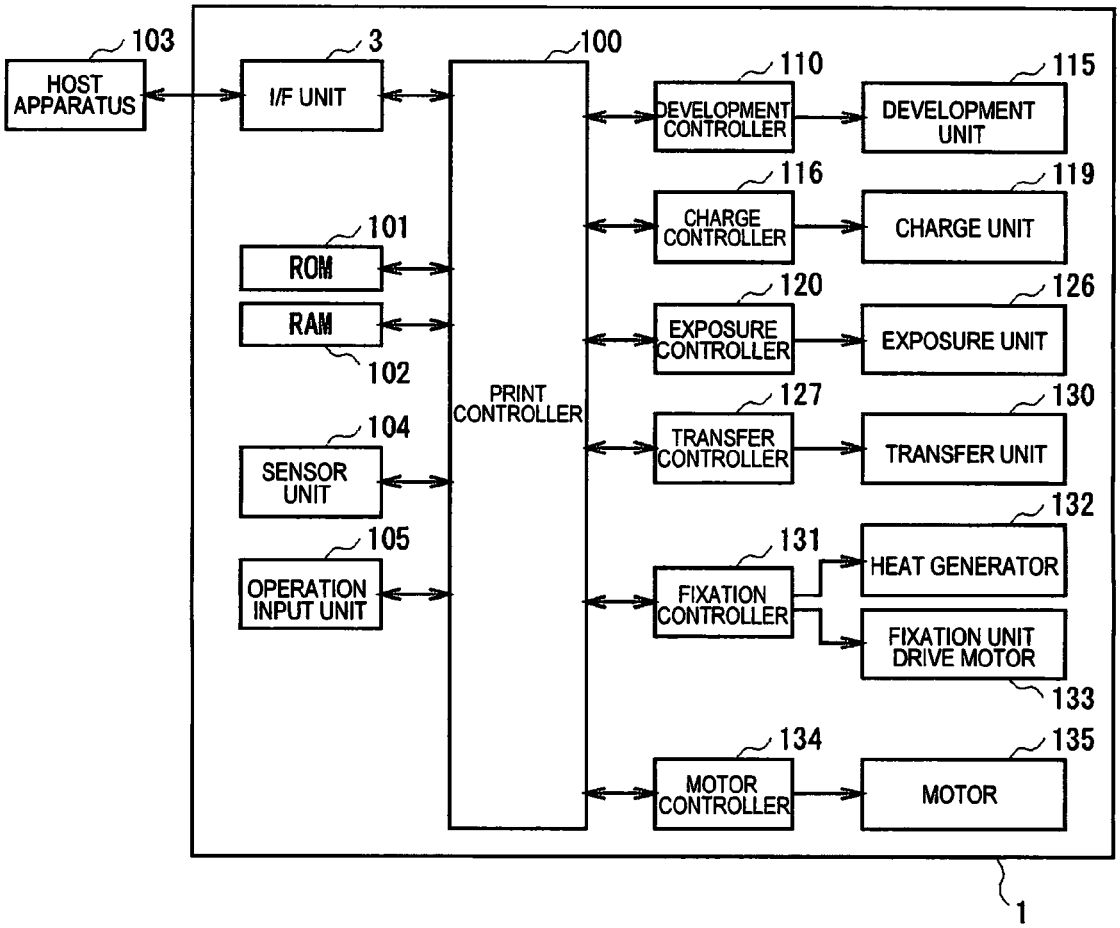
FIG. 2 is a block diagram illustrating the circuit configuration of the color printer.
Figure 3:
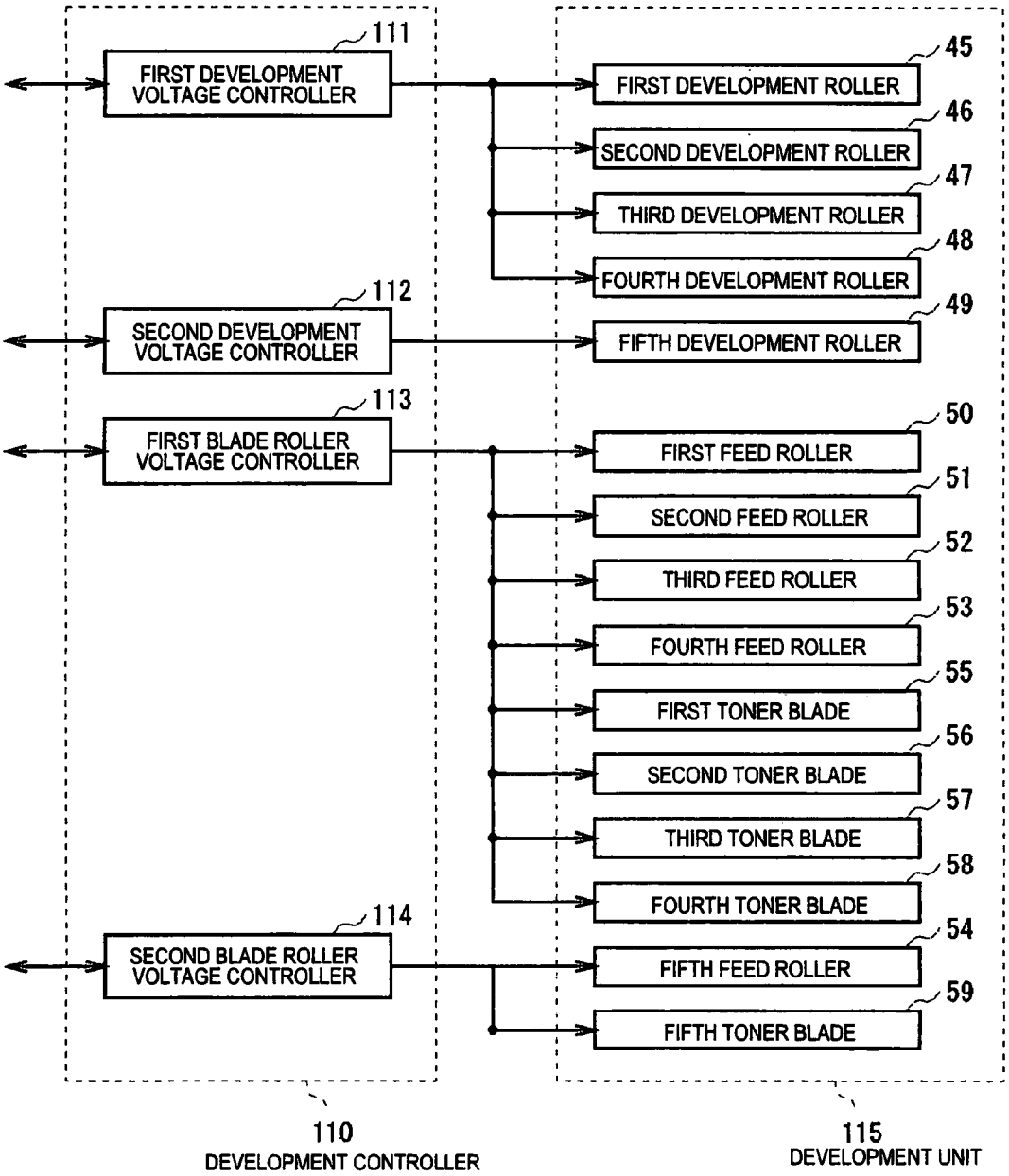
FIG. 3 is a block diagram illustrating the circuit configurations of a development controller and a development unit.
Figure 8A:
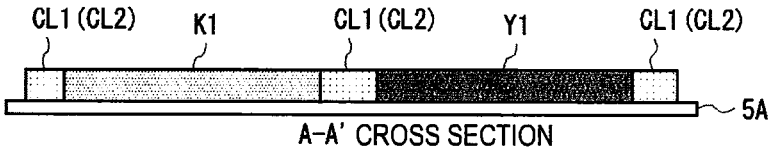
FIGS. 8A to 8D are schematic cross-sectional views provided for description of the first evaluation pattern (2) formed with basic color toners and a clear toner on the surface of plain paper.
Figure 8B:
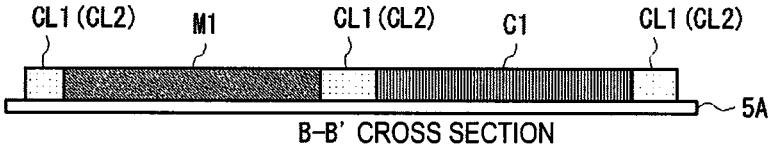
Figure 8C:
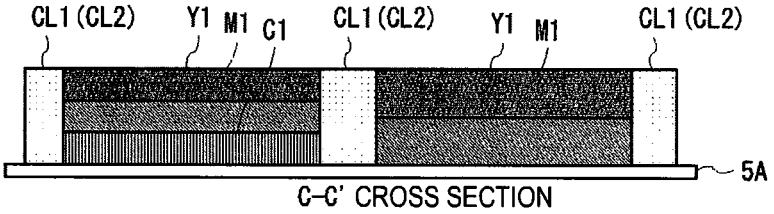
Figure 8D:
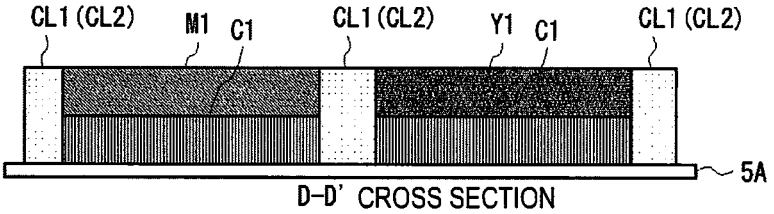
Figure 12:
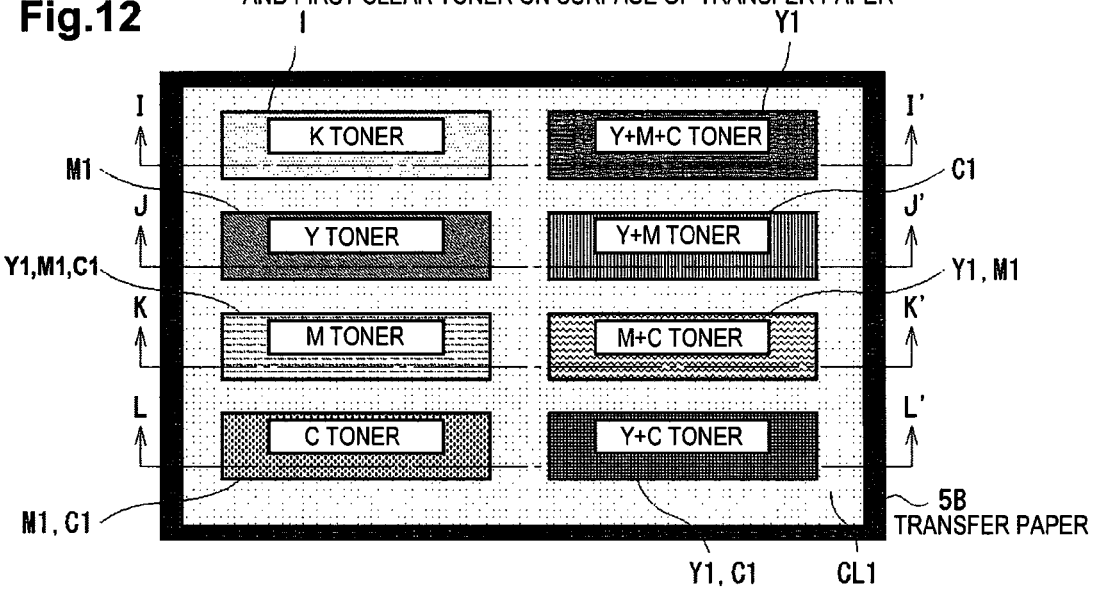
FIG. 12 is a schematic top view provided for the description of third evaluation pattern (1) formed with basic color toners and a first clear toner on the surface of transfer paper.
Figure 13A:
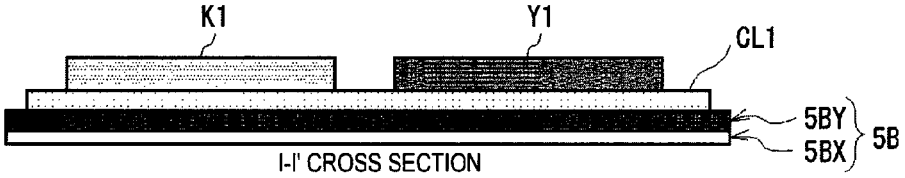
FIGS. 13A to 13D are schematic cross-sectional views provided for the description of third evaluation pattern (2) formed with basic color toners and a first clear toner on the surface of transfer paper.
Figure 13B:
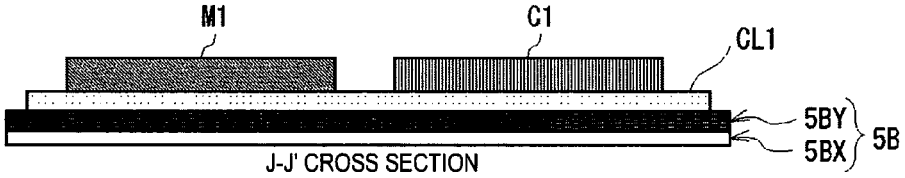
Figure 13C:
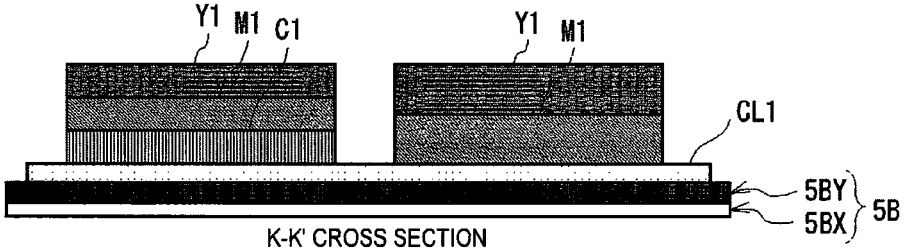
Figure 13D:
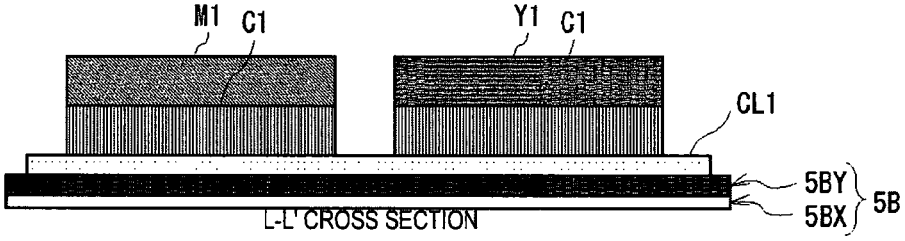
Figure 14:
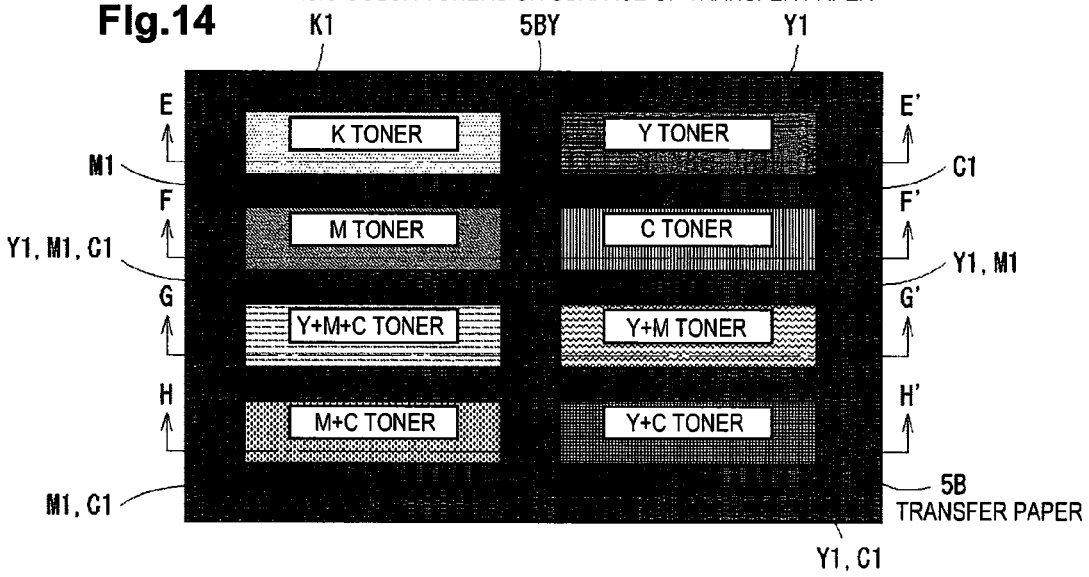
FIG. 14 is a schematic top view provided for the description of fourth evaluation pattern (1) formed with basic color toners on the surface of transfer paper.
Figure 15A:
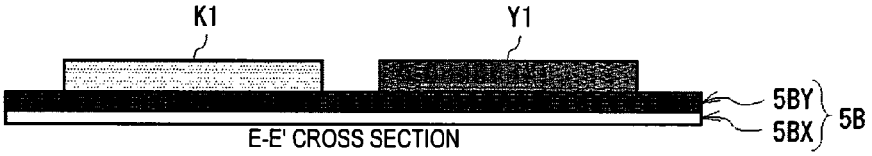
FIGS. 15A to 15D are schematic cross-sectional views provided for the description of fourth evaluation pattern (2) formed with basic color toners on the surface of transfer paper.
Figure 15B:
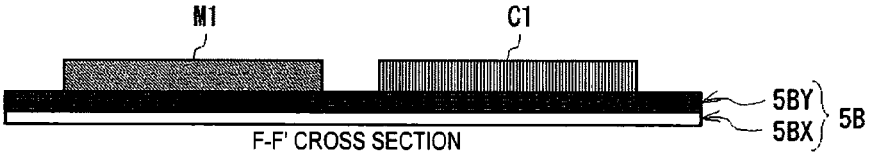
Figure 15C:
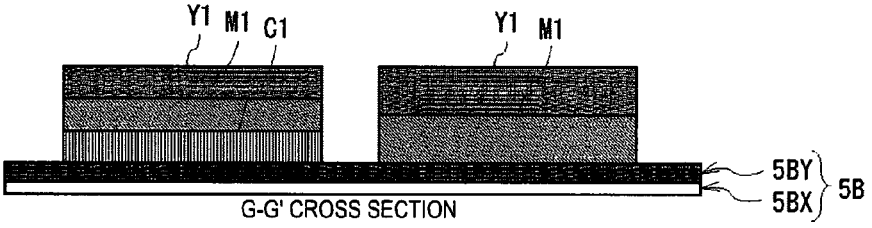
Figure 15D:
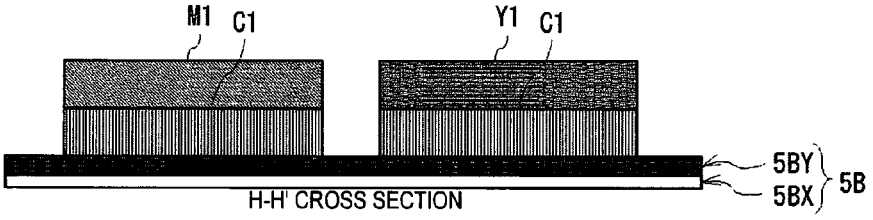

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

The description is provided in the following order: (1) First embodiment; (2) Second embodiment; and (3) Other embodiments.

(1) First Embodiment (1-1) Internal Configuration of Color Printer

In FIG. 1, reference numeral 1 generally indicates a secondary transfer-type color printer according to the invention. Color printer 1 has, for example, an approximately box-shaped housing (hereinafter also referred to as a printer housing) 2 having front surface 2A at the right end face of the figure. In the following description, the upward direction of color printer 1, as indicated by arrow al in the figure when color printer 1 is viewed from front surface 2A of printer housing 2, is also referred to as a printer upward direction. The direction opposite to the printer upward direction is referred to as a printer downward direction. When there is no particular need to distinguish these directions from each other, or when referring to both of the directions, these directions are collectively referred to as a printer vertical direction. In the following description, the frontward direction of color printer 1, as indicated by arrow b1 in the figure when color printer 1 is viewed from front surface 2A of printer housing 2, is also referred to as a printer frontward direction, and the direction opposite to the printer frontward direction is also referred to as a printer rearward direction. When there is no particular need to distinguish these directions from each other, or when referring to both of the directions, these directions are collectively referred to as a printer front-rear direction. Furthermore, in the following description, the leftward direction of color printer 1 as indicated by arrow c1 in the figure when color printer 1 is viewed from front surface 2A of printer housing 2 is also referred to as a printer leftward direction, and the direction opposite to the printer leftward direction is also referred to as a printer rightward direction. When there is no particular need to distinguish these directions from each other, or when referring to both the directions, these directions are collectively referred to as a printer left-right direction.

Printer housing 2 includes, for example, an operation panel (not shown) having various operation keys and a liquid crystal panel (s) at predetermined positions in the upper end of front surface 2A. Printer housing 2 also includes, for example, interface unit 3, such as a Universal Serial Bus (USB) or an interface in accordance with The Institute of Electrical and Electronics Engineers 802 (IEEE 802), for a wired connection or a wireless connection with a host apparatus, such as an external personal computer, in accordance with wired communication standards or wireless communication standards wherein interface unit 3 is disposed at a predetermined position in the lower end of back surface 2B. Furthermore, printer housing 2 includes a recess (hereinafter also referred to as a medium delivery unit) 2CX in the rear end of top surface 2C. Recess 2CX is configured to receive rectangular print medium 5 having a print image formed on the surface and to deliver it to a user. Printer housing 2 includes medium ejection port 2CY at a predetermined position in the rear inner wall of medium delivery unit 2CX. Medium ejection port 2CY is configured to eject print medium 5 with the print image from the inside of printer housing 2 to medium delivery unit 2CX. Printer housing 2 further includes, for example, an openable door (not shown) in the left end.

Printer housing 2 contains image formation section 7 from the central part to the upper end, wherein image formation section 7 is configured to form a color print image (that is, to print a color image targeted for printing) on the surface of print medium 5. Printer housing 2 contains medium feeder 8 in the lower end, wherein medium feeder 8 is configured to feed print medium 5 to image formation section 7 for a formation of the print image on the print medium. Image formation section 7 has, for example, five first to fifth image formation units 10 to 14 configured to form toner images as developer images using as developers a total of five color toners, namely, toners of yellow (Y), magenta (M), cyan (C), and black (K) as the basic colors for print image formation, and clear (CL) as a special color for the print image formation so that these toners are not overlapped with each other. Image formation section 7 has transfer unit 15 configured to transfer five color toner images formed with first to fifth image formation units 10 to 14 to the surface of print medium 5. The image formation section 7 also has fixation unit 16 configured to fix these five color toner images to the surface of print medium 5.

First to fifth image formation units 10 to 14 are provided in the upper end in printer housing 2 in a detachable manner through the door. When installed in the upper end in printer housing 2, first to fifth image formation units 10 to 14 are arranged at predetermined regular intervals from the front to the rear, for example, in the order corresponding to clear (CL), black (K), cyan (C), magenta (M), and yellow (Y). First to fifth image formation units 10 to 14 have the same configuration except that toners of different single colors are used for toner image formation. First to fifth image formation units 10 to 14 have first to fifth unit frames 20 to 24, respectively, that are long in the printer left-right direction. The top surface rear ends of first to fifth unit frames 20 to 24 are detachably equipped with first to fifth toner cartridges 25 to 29 configured to store toners of corresponding colors, respectively. First to fifth image formation units 10 to 14 include first to fifth photosensitive drums 30 to 34 as image carriers configured to carry respective toner images; first to fifth charge rollers 35 to 39 as charge units configured to charge the outer circumferential surfaces of first to fifth photosensitive drums 30 to 34; and first to fifth light emitting diode (LED) heads 40 to 44 as exposure units configured to irradiate the outer circumferential surfaces of first to fifth photosensitive drums 30 to 34 with LEDs to form electrostatic latent images that produce toner images, respectively. First to fifth image formation units 10 to 14 also have first to fifth development rollers 45 to 49 as developer carriers configured to carry the toners on the outer circumferential surfaces and to develop the electrostatic latent image on the outer circumferential surfaces of first to fifth photosensitive drums 30 to 34; and first to fifth feed rollers 50 to 54 as developer feeders configured to feed the toners to the outer circumferential surfaces of first to fifth development rollers 45 to 49, respectively. First to fifth image formation units 10 to 14 also further have first to fifth toner blades 55 to 59, respectively, as a developer thickness controller configured to control the thickness of the toners on the respective outer circumferential surfaces of first to fifth development rollers 45 to 49; and first to fifth cleaning blades 60 to 64 as residual developer removers configured to remove residual toner on the outer circumferential surfaces of first to fifth photosensitive drums 30 to 34, respectively.

In this case, first to fifth photosensitive drums 30 to 34 are, for example, formed as organic photoreceptors having a photosensitive layer with a predetermined thickness on the surface of a drum-shaped (i.e., cylindrical) conductive base, such as aluminum, and are provided with conductive metal shafts projecting at both ends. The photosensitive layer in first to fifth photosensitive drums 30 to 34 includes a laminate of a blocking layer, a charge generation layer, and a charge transport layer in this order from the surface of the conductive base to the outside. The thickness of, for example, the charge transport layer of these layers is set to about 18 μm. First to fifth image formation units 10 to 14 rotatably support first to fifth photosensitive drums 30 to 34 in one rotation direction indicated by arrow dl (i.e., in the counterclockwise direction as viewed from the left side) in the figure around a shaft parallel to the printer left-right direction in a substantially central part in first to fifth unit frames 20 to 24, respectively. In first to fifth image formation units 10 to 14, thus the lower parts of the outer circumferential surfaces of first to fifth photosensitive drums 30 to 34 are allowed to project slightly downward from the bottom of first to fifth unit frames 20 to 24. When first to fifth image formation units 10 to 14 each are installed in printer housing 2, the shafts of first to fifth photosensitive drums 30 to 34 are connected to the output shaft of a motor (not shown) configured to drive first to fifth image formation units 10 to 14 (hereinafter also referred to as an image formation unit drive motor). Therefore, first to fifth image formation units 10 to 14 can rotate first to fifth photosensitive drums 30 to 34 in the one rotation direction according to the operation of the image formation unit drive motor.

First to fifth charge rollers 35 to 39 each include, for example, a roller main body being a cylindrical elastic body, such as a semi-conductive hydrin rubber, in the central part of the conductive metal shafts. First to fifth image formation units 10 to 14 rotatably support first to fifth charge rollers 35 to 39 in the other rotation direction (i.e., in the clockwise direction as viewed from the left side) opposite to the one rotation direction around a shaft parallel to the printer left-right direction in the upper front end in first to fifth unit frames 20 to 24, respectively. This configuration allows the diagonally lower parts of the rear outer circumferential surfaces of first to fifth charge rollers 35 to 39 (i.e., the outer circumferential surface of the roller main body) to be pressed against the diagonally upper parts of the front outer circumferential surfaces of first to fifth photosensitive drums 30 to 34 at a predetermined pressure in first to fifth image formation units 10 to 14. Therefore, when first to fifth photosensitive drums 30 to 34 rotate in the one rotation direction according to the operation of the image formation unit drive motor, first to fifth image formation units 10 to 14 can rotate first to fifth charge rollers 35 to 39 in the other rotation direction with the rotation of first to fifth photosensitive drums 30 to 34, with first to fifth charge rollers 35 to 39 being pressed against first to fifth photosensitive drums 30 to 34.

First to fifth LED heads 40 to 44 have, for example, elongated head cases, respectively. The head cases include an array of LED elements in the longitudinal direction (hereinafter also referred to as a head longitudinal direction) of the head cases. In the head cases of first to fifth LED heads 40 to 44, a lens array is disposed so that a light entrance surface of the lens array faces the light emission surfaces of LED elements and the light-exit surface of the lens array is exposed. In first to fifth image formation units 10 to 14, first to fifth LED heads 40 to 44 are disposed in substantially central parts of the top surfaces of first to fifth unit frames 20 to 24, respectively. This is so that the head longitudinal direction is parallel to the printer left-right direction and the light-exit surface of the lens array is opposed to the upper parts of the outer circumferential surfaces of first to fifth photosensitive drums 30 to 34. This configuration allows the portions in the outer circumferential surfaces of first to fifth photosensitive drums 30 to 34, charged with first to fifth charge rollers 35 to 39, to be exposed to irradiation light emitted from the light emitting surfaces of LED elements in first to fifth LED heads 40 to 44 for electrostatic latent image formation in first to fifth image formation units 10 to 14

First to fifth development rollers 45 to 49 each include, for example, a roller main body being a cylindrical elastic body, such as a semi-conductive urethane rubber having a hardness of 70° (Asker C) in the central part of the conductive metal shafts. First to fifth image formation units 10 to 14 rotatably support first to fifth development rollers 45 to 49 in the other rotation direction around shafts parallel to the printer left-right direction in the rear end in first to fifth unit frames 20 to 24, respectively. This configurations allows the diagonally lower parts of the front outer circumferential surfaces of first to fifth development rollers 45 to 49 (i.e., the outer circumferential surface of the roller main body) to be pressed against the diagonally upper parts of the rear outer circumferential surfaces of first to fifth photosensitive drums 30 to 34 at a predetermined pressure in first to fifth image formation units 10 to 14. When first to fifth image formation units 10 to 14 each are installed in printer housing 2, the shafts of first to fifth development rollers 45 to 49 are connected to the output shaft of the image formation unit drive motor. Therefore, first to fifth image formation units 10 to 14 can rotate first to fifth development rollers 45 to 49 in the other rotation direction for electrostatic latent image formation according to the operation of the image formation unit drive motor while first to fifth development rollers 45 to 49 are pressed against first to fifth photosensitive drums 30 to 34 rotating in the one rotation direction.

First to fifth feed rollers 50 to 54 each include, for example, a roller main body being a cylindrical foam such as silicone sponge having a hardness of 50° (Asker F) in the central part of the conductive metal shafts. First to fifth image formation units 10 to 14 rotatably support first to fifth feed rollers 50 to 54 in the other rotation direction around shafts parallel to the printer left-right direction in the rear upper end in first to fifth unit frames 20 to 24, respectively. This configuration allows the diagonally lower parts of the front outer circumferential surfaces of first to fifth feed rollers 50 to 54 (i.e., the outer circumferential surface of the roller main body) to be pressed against the diagonally upper parts of the rear outer circumferential surfaces of first to fifth development rollers 45 to 49 at a predetermined pressure in first to fifth image formation units 10 to 14. When first to fifth image formation units 10 to 14 each are installed in printer housing 2, the shafts of first to fifth feed rollers 50 to 54 are connected to the output shaft of the image formation unit drive motor. Therefore, first to fifth image formation units 10 to 14 can rotate first to fifth feed rollers 50 to 54 in the other rotation direction according to the operation of the image formation unit drive motor while first to fifth feed rollers 50 to 54 are pressed against first to fifth development rollers 45 to 49 rotating in the other rotation direction. In first to fifth image formation units 10 to 14, thus the toners fed to first to fifth unit frames 20 to 24 from first to fifth toner cartridges 25 to 29 can be supplied to the outer circumferential surfaces of first to fifth development rollers 45 to 49 with first to fifth feed rollers 50 to 54.

First to fifth toner blades 55 to 59 are made of a conductive metal, such as stainless steel and phosphor bronze, and have a substantially strip shape. In first to fifth image formation units 10 to 14, the longitudinal direction of first to fifth toner blades 55 to 59 is parallel to the printer left-right direction, and one edge of first to fifth toner blades 55 to 59 is fixed to the inside of first to fifth unit frames 20 to 24 at a predetermined position. This configuration allows the other edge of first to fifth toner blades 55 to 59 to be in pressure contact with the diagonally front upper parts of the outer circumferential surfaces of first to fifth development rollers 45 to 49, while the other edge of first to fifth toner blades 55 to 59 is directed diagonally backward and downward in first to fifth image formation units 10 to 14. Therefore, first to fifth image formation units 10 to 14 can remove excessive toners over the predetermined thickness from the outer circumferential surface of first to fifth development rollers 45 to 49 with first to fifth toner blades 55 to 59 by the rotation of first to fifth development rollers 45 to 49 in the other rotation direction, even if the toners over the predetermined thickness are fed to the outer circumferential surfaces of first to fifth development rollers 45 to 49 from first to fifth feed rollers 50 to 54. Accordingly, first to fifth image formation units 10 to 14 can control the thickness of toners carried on the outer circumferential surfaces of first to fifth development rollers 45 to 49 with first to fifth toner blades 55 to 59.

First to fifth cleaning blades 60 to 64 are made of, for example, an elastomer such as urethane rubber having a hardness of 68° in accordance with the JDD-A standard and have a substantially strip shape. In first to fifth image formation units 10 to 14, the longitudinal direction of first to fifth cleaning blades 60 to 64 is parallel to the printer left-right direction, and one edge of first to fifth cleaning blades 60 to 64 is fixed to the inside of first to fifth unit frames 20 to 24 at a predetermined position. This configuration allows the other edge of first to fifth cleaning blades 60 to 64 to be in contact with the front parts of the outer circumferential surfaces of first to fifth photosensitive drums 30 to 34 while the other edge of first to fifth cleaning blades 60 to 64 is directed diagonally forward and downward in first to fifth image formation units 10 to 14. First to fifth image formation units 10 to 14 accordingly can remove residual toners on the outer circumferential surfaces of first to fifth photosensitive drums 30 to 34 with first to fifth cleaning blades 60 to 64.

Transfer unit 15, on the other hand, has a unit frame (not shown) and is disposed near and below five first to fifth image formation units 10 to 14. In transfer unit 15, the unit frame rotatably supports drive roller 70 for belt driving in the other rotation direction around a shaft parallel to the printer left-right direction at a predetermined position in the diagonally rearward and downward side of the rearmost fifth image formation unit 14. In transfer unit 15, the unit frame further rotatably supports driven roller 71 in the other rotation direction around a shaft parallel to the printer left-right direction at a predetermined position in the diagonally forward and downward side of the foremost first image formation unit 10. In transfer unit 15, the unit frame rotatably supports backup roller 72 in the other rotation direction around a shaft parallel to the printer left-right direction at a predetermined position below drive roller 70 and driven roller 71. In transfer unit 15, an endless belt (hereinafter also referred to as a transfer belt) 73 configured to transfer toner images is stretched from drive roller 70 through driven roller 71 and backup roller 72 to form a substantial inverted triangle. In transfer unit 15, the upper part of transfer belt 73 from drive roller 70 to driven roller 71 is substantially flat while being in contact with the lower parts of the outer circumferential surfaces of first to fifth photosensitive drums 30 to 34. In transfer unit 15, the shaft of drive roller 70 is connected to the output shaft of a motor (not shown) configured to drive transfer unit 15 (hereinafter also referred to as a transfer unit drive motor). Transfer unit 15 thus can rotate drive roller 70 in the other rotation direction according to the operation of the transfer unit drive motor and can rotate driven roller 71 and backup roller 72 as well as transfer belt 73 in the other rotation direction with the rotation of drive roller 70.

Transfer belt 73 has a two-layer structure in which a conductive layer made of a low resistance material with a low electrical resistance is laminated on the back surface of a high resistance layer with a relatively higher electrical resistance, such as an endless plastic film. The surface of the high resistance layer as the outer circumferential surface of transfer belt 73 is in contact with the outer circumferential surfaces of first to fifth photosensitive drums 30 to 34. The high resistance layer of transfer belt 73 is formed to have a volume resistivity of about from $10^{11}$ to $10^{13}$ Ωcm by, for example, the addition of carbon to polyamidoimide (PAI). The conductive layer of transfer belt 73 is formed as, for example, an aluminum thin film, which is a conductive member having a volume resistivity of $10^{14}$ Ωcm or less, and is attached to the back surface of the high resistance layer with tension applied, or vapor deposited on it.

In addition, in transfer unit 15, the unit frame arranges five primary transfer rollers 74 to 78 in sequence from the front to the rear inside the substantially flat upper part of transfer belt 73 and rotatably supports primary transfer rollers 74 to 78 in the other rotation direction around the respective shafts parallel to the printer left-right direction, wherein primary transfer rollers 74 to 78 are configured to transfer toner images on the outer circumferential surfaces of first to fifth photosensitive drums 30 to 34 to the outer circumferential surface of transfer belt 73. This configuration allows the upper parts of the outer circumferential surfaces of these five primary transfer rollers 74 to 78 to be pressed against the lower parts of the outer circumferential surfaces of the corresponding first to fifth photosensitive drums 30 to 34 through the upper part of transfer belt 73 in transfer unit 15. In transfer unit 15, secondary transfer roller 79 is provided under backup roller 72 and can be rotated in the one rotation direction around a shaft parallel to the printer left-right direction, wherein secondary transfer roller 79 is configured to transfer five color toner images on the outer circumferential surfaces, which are conveyed by the rotation of transfer belt 73, to the surface of print medium 5. This configuration allows the upper part of the outer circumferential surface of secondary transfer roller 79 to be pressed against the lower part of the outer circumferential surface of secondary transfer roller 79 through transfer belt 73 in transfer unit 15. In the following description, the position on the outer circumferential surface of transfer belt 73 where transfer belt 73 is sandwiched between secondary transfer roller 79 and backup roller 72 by secondary transfer roller 79 is also referred to as a secondary transfer position.

Fixation unit 16 is provided in a detachable manner through the door in the central rear end in printer housing 2. When being installed in the central rear end in printer housing 2, fixation unit 16 is disposed at a predetermined position in the rear of secondary transfer roller 79 of transfer unit 15. Fixation unit 16 has unit frame 85 capable of receiving print medium 5 from the front and ejecting it to the rear. Fixation unit 16 also includes an internal heat generator (not shown), such as a halogen lamp, and also has heat roller 86 configured to heat print medium 5 and the toners (i.e., toner images) on the surface of print medium 5, and press roller 87 configured to press print medium 5 and the toners (i.e., toner images) on the surface of print medium 5. Fixation unit 16 rotatably supports heat roller 86 in the other rotation direction around a shaft parallel to the printer left-right direction in the upper end in unit frame 85, and includes a temperature sensor (not shown) configured to detect the temperature of the outer circumferential surface of heat roller 86 without contact. Fixation unit 16 rotatably supports press roller 87 in the one rotation direction around a shaft parallel to the printer left-right direction in the lower end in unit frame 85. This configuration allows the upper part of the outer circumferential surface of press roller 87 to be pressed against the lower part of the outer circumferential surface of heat roller 86 in fixation unit 16.

When fixation unit 16 is installed in printer housing 2, for example, the shafts of heat roller 86 and press roller 87 each are connected to the output shaft of a motor (not shown) configured to drive fixation unit 16 (hereinafter also referred to as a fixation unit drive motor). Furthermore, when fixation unit 16 is installed in printer housing 2, the heat generator in heat roller 86 is electrically connected to a predetermined heat generator power supply. Because of this, fixation unit 16 heats the outer circumferential surface of heat roller 86 by heat generated from the heat generator with the heat generator power supply activated. At the same time, the fixation unit rotates heat roller 86 in the other direction and press roller 87 in the one rotation direction with the outer circumferential surface of press roller 87 being pressed against the outer circumferential surface of heat roller 86 according to the operation of the fixation unit drive motor. Therefore, fixation unit 16 heats and presses print medium 5 having five color toner images transferred to the surface so that print medium 5 is conveyed so as to be sandwiched between heat roller 86 and press roller 87, whereby the five color toner images can be fixed to the surface of print medium 5. For fixation unit 16, for example, the installation position of press roller 87 with respect to unit frame 85 can be adjusted while fixation unit 16 is taken out of printer housing 2. Therefore, in fixation unit 16, the adjustment of the installation position of press roller 87 with respect to unit frame 85 can change the pressure applied to print medium. 5 when print medium 5 is conveyed so as to be sandwiched between heat roller 86 and press roller 87 (i.e., the pressure applied to print medium 5 sandwiched between heat roller 86 and press roller 87, hereinafter also referred to as a nip pressure).

Medium feeder 8 includes medium cassette 90 to be loaded with print media 5 in a stacked manner. Medium cassette 90 is loaded with, for example, A3 size print media 5 with the longitudinal direction being parallel to the printer front-rear direction. Medium cassette 90 can be loaded with various sizes of print media 5, for example, A4 size print media 5 with the longitudinal direction being parallel to the printer front-rear direction. Medium feeder 8 includes delivery roller 91 configured to deliver print medium 5 out of medium cassette 90 wherein delivery roller 91 can be rotated in the one rotation direction around a shaft parallel to the printer left-right direction and the shaft is connected to the output shaft of a delivery motor.

In addition to these, printer housing 2 contains conveyance unit (hereinafter also referred to as a medium feed conveyance unit) 93 configured to convey print medium 5 to image formation section 7. Conveyance unit 93 ranges from near the diagonally forward and upward side of medium cassette 90 to near the front of secondary transfer roller 79 and backup roller 72 of transfer unit 15. Medium feed conveyance unit 93 forms a conveyance path (hereinafter also referred to as a medium feed conveyance path) configured to convey print medium 5 delivered from medium cassette 90 to image formation section 7, wherein the conveyance path is composed of various conveyance path formation parts, such as pairs of conveyance rollers, conveyance guides, a medium feed conveyance motor, and various sensors for controlling the conveyance. Printer housing 2 contains conveyance unit (hereinafter also referred to as a medium ejection conveyance unit) 94 configured to convey print medium 5 having a print image formed on the surface for ejection from medium ejection port 2CY. Conveyance unit 94 ranges from near the rear of fixation unit 16 to near medium ejection port 2CY. Medium ejection conveyance unit 94 forms a conveyance path (hereinafter also referred to as a medium ejection conveyance path) configured to convey print medium 5 delivered from fixation unit 16 to medium ejection port 2CY, wherein the conveyance path is composed of various conveyance path formation parts, such as pairs of conveyance rollers, conveyance guides, a medium ejection conveyance motor, and various sensors for controlling the conveyance.

Printer housing 2 further contains, for example, position detection sensor 95 configured to detect whether the end of print medium 5 conveyed through the medium feed conveyance path (i.e., one downstream end of print medium 5 out of the ends positioned downstream and upstream of the conveyance direction during conveyance) reaches a predetermined position before the secondary transfer position (i.e., a predetermined position upstream of the secondary transfer position in the conveyance direction of print medium 5). It is noted that position detection sensor 95 is used to control the position of the toner image transferred to the surface of print medium 5 with secondary transfer roller 79. Printer housing 2 contains separator 96 at a predetermined position in the rear of fixation unit 16, wherein separator 96 is configured to switch between the ejection of print medium 5 and the re-feed of print medium 5 to between secondary transfer roller 79 and backup roller 72. Printer housing 2 also contains medium re-feed conveyance unit 97 between image formation section 7 and medium feeder 8, wherein medium re-feed conveyance unit 97 is configured to convey and re-feed print medium 5 delivered from fixation unit 16 to between secondary transfer roller 79 and backup roller 72 without changing the surface of print medium 5 on which the print image is formed. Medium re-feed conveyance unit 97 is used to, for example, change the overlap order of five color toner images to be transferred to the surface of print medium 5 (for example, to change whether the clear toner image of five color toner images is placed lowermost or uppermost).

(1-2) Circuit Configuration of Color Printer 1

The circuit configuration of color printer 1 is next described with reference to FIGS. 2 to 6. Color printer 1 has control unit (hereinafter also referred to as a print controller) 100 configured to control the entire color printer 1 for print image formation on the surface of print medium 5. Print controller 100 is connected to read only memory (ROM) 101 that stores in advance various programs and various parameters for controlling the entire color printer 1 for print image formation on the surface of print medium 5 and to random access memory (RAM) 102 being a work area of print controller 100. Print controller 100 is connected to host apparatus 103 through interface unit 3 mentioned above, and is also connected to a temperature sensor (i.e., temperature sensor of fixation unit 16 mentioned above), position detection sensor 95, and sensor unit 104 having various sensors for controlling the conveyance, and further connected to operation input unit 105 having various operation keys on the operation panel mentioned above.

In addition to these, print controller 100 is connected to first and second development voltage controllers 111 and 112 and first and second blade roller voltage controllers 113 and 114 that have their respective predetermined voltage sources. Development controller 110 is configured to control the development of electrostatic latent images on the outer circumferential surfaces of first to fifth photosensitive drums 30 to 34 in first to fifth image formation units 10 to 14. First development voltage controller 111 is electrically connected to first to fourth development rollers 45 to 48 of first to fourth image formation units 10 to 13. Development unit 115 is configured to develop the electrostatic latent images on the outer circumferential surfaces of first to fifth photosensitive drums 30 to 34 in first to fifth image formation units 10 to 14. Second development voltage controller 112 is electrically connected to fifth development roller 49 of fifth image formation unit 14 as development unit 115. Furthermore, first blade roller voltage controller 113 is electrically connected to first to fourth feed rollers 50 to 53 and first to fourth toner blades 55 to 58 of first to fourth image formation units 10 to 13 as development unit 115. In addition, second blade roller voltage controller 114 is electrically connected to fifth feed roller 54 and fifth toner blade 59 of fifth image formation unit 14 as development unit 115.

Print controller 100 is connected to first and second charge voltage controllers 117 and 118 that have their respective predetermined voltage sources. Charge controller 116 is configured to control the charge on the outer circumferential surfaces of first to fifth photosensitive drums 30 to 34 in first to fifth image formation units 10 to 14. First charge voltage controller 117 is electrically connected to first to fourth charge rollers 35 to 38 of first to fourth image formation units 10 to 13. Charge unit 119 is configured to charge the outer circumferential surfaces of first to fifth photosensitive drums 30 to 34 in first to fifth image formation units 10 to 14. Second charge voltage controller 118 is electrically connected to fifth development roller 39 of fifth image formation unit 14 as charge unit 119 of second charge voltage controller 118. Print controller 100 is further connected to first to fifth head controllers 121 to 125 as exposure controller 120 configured to control the exposure of the outer circumferential surfaces of first to fifth photosensitive drums 30 to 34 (i.e., the exposure to form electrostatic latent images) in first to fifth image formation units 10 to 14. First to fifth head controllers 121 to 125 are connected to the corresponding first to fifth LED heads 40 to 44 in first to fifth image formation units 10 to 14, respectively, as exposure unit 126 configured to expose the outer circumferential surfaces of first to fifth photosensitive drums 30 to 34 to form electrostatic latent images in first to fifth image formation units 10 to 14.

Print controller 100 is further connected to first and second transfer voltage controllers 128 and 129 having their respective predetermined voltage sources as transfer controller 127 configured to control the transfer of toner images to the outer circumferential surface of transfer belt 73 or the surface of print medium 5 in transfer unit 15. First transfer voltage controller 128 is then electrically connected to five primary transfer rollers 74 to 78 in transfer unit 15 as transfer unit 130 configured to transfer toner images to the outer circumferential surface of transfer belt 73 or the surface of print medium 5 in transfer unit 15. Second transfer voltage controller 129 is electrically connected to secondary transfer roller 79 of transfer unit 15 as transfer unit 130. Print controller 100 is further connected to fixation controller 131 configured to control fixation unit 16. Fixation controller 131 is connected to the aforementioned heat generator 132 in fixation unit 16 and to the aforementioned fixation unit drive motor 133. Print controller 100 is still further connected to motor controller 134. Motor controller 134 is connected to the image formation unit drive motor, transfer unit drive motor, delivery motor, medium feed conveyance motor, and medium ejection conveyance motor mentioned above as motor 135.

Print controller 100 having such a configuration, for example, receives image data expressing a color image to be printed through interface unit 3 from host apparatus 103, and executes print image formation processing for forming a print image (i.e., printing a color image) on the surface of print medium 5 upon the direction of color image printing. In the print image formation processing, print controller 100 causes fixation controller 131 to activate fixation unit drive motor 133. The activation thus rotates heat roller 86 in the other rotation direction as described above and press roller 87 in the one rotation direction in fixation unit 16. Print controller 100 causes fixation controller 131 to initiate heat generation from heat generator 132 based on the detection result of the temperature of the outer circumferential surface of heat roller 86 from the temperature sensor as sensor unit 104. The heat generated heats the outer circumferential surface of heat roller 86 to a desired temperature. Print controller 100 further causes motor controller 134 to activate the image formation unit drive motor and thus rotates first to fifth photosensitive drums 30 to 34, first to fifth development rollers 45 to 49, and first to fifth feed rollers 50 to 54 in first to fifth image formation units 10 to 14 in the one rotation direction or the other rotation direction as described above. Print controller 100 accordingly rotates first to fifth photosensitive drums 30 to 34 in the one rotation direction, and at the same time rotates first to fifth charge rollers 35 to 39 in the other rotation directions with the rotation of first to fifth photosensitive drums 30 to 34 in first to fifth image formation units 10 to 14.

In addition, print controller 100 causes first and second charge voltage controllers 117 and 118 to apply a DC voltage with a predetermined voltage value to first to fifth charge rollers 35 to 39. Print controller 100 causes first and second development voltage controllers 111 and 112 to apply a DC voltage with a predetermined voltage value to first to fifth development rollers 45 to 49. Print controller 100 accordingly causes first to fifth charge rollers 35 to 39 to charge the outer circumferential surfaces of first to fifth photosensitive drums 30 to 34 so that electrostatic latent images can be formed on the outer circumferential surfaces in first to fifth image formation units 10 to 14. Print controller 100 also causes first and second blade roller voltage controllers 113 and 114 to apply a DC voltage with a predetermined voltage value to first to fifth feed rollers 50 to 54 and first to fifth toner blades 55 to 59 in first to fifth image formation units 10 to 14. Print controller 100 accordingly causes first to fifth feed rollers 50 to 54 to feed the toners to first to fifth development rollers 45 to 49 in first to fifth image formation units 10 to 14, and causes first to fifth toner blades 55 to 59 to allow the outer circumferential surfaces of first to fifth development rollers 45 to 49 to carry a proper amount of the toner for electrostatic latent image development.

Furthermore, print controller 100 causes motor controller 134 to activate the transfer unit drive motor and thus rotate drive roller 70 in the other rotation direction as described above, and at the same time, rotate driven roller 71 and backup roller 72 as well as transfer belt 73 in the other rotation direction with the rotation of drive roller 70 in transfer unit 15. In addition, print controller 100 causes first and second transfer voltage controllers 128 and 129 to apply a DC voltage with a predetermined voltage value to five primary transfer rollers 74 to 78 and secondary transfer roller 79 in transfer unit 15. Print controller 100 accordingly allows the toner images to be transferred to transfer belt 73 from the outer circumferential surfaces of first to fifth photosensitive drums 30 to 34 in first to fifth image formation units 10 to 14, and also allows the toner images to be transferred from transfer belt 73 to the surface of print medium 5.

Print controller 100 then causes motor controller 134 to activate the medium feed conveyance motor and the medium ejection conveyance motor to drive medium feed conveyance unit 93 and medium ejection conveyance unit 94. This further causes motor controller 134 to activate the delivery motor. Print controller 100 accordingly causes delivery roller 91 to deliver print media 5 one by one out of medium cassette 90 and to convey the delivered print medium 5 to image formation section 7 through the medium feed conveyance path with the conveyance position being appropriately corrected. During the conveyance, print controller 100, for example, produces five types of print color data expressing yellow, magenta, cyan, black, and clear color components according to the image data, and also sends out the five types of print color data produced to the corresponding first to fifth head controllers 121 to 125. First to fifth head controllers 121 to 125 each convert the print color data of one color provided from print controller 100 to head control data for individually controlling the corresponding first to fifth LED heads 40 to 44. First to fifth head controllers 121 to 125 then send out the head control data to the corresponding first to fifth LED heads 40 to 44 at a different timing respectively, and thus control the corresponding first to fifth LED heads 40 to 44 according to the head control data.

Print controller 100 accordingly causes fifth image formation unit 14, fourth image formation unit 13, third image formation unit 12, second image formation unit 11, and first image formation unit 10 in this order to form electrostatic latent images on the outer circumferential surfaces of first to fifth photosensitive drums 30 to 34 with first to fifth LED heads 40 to 44 and, at the same time, to start the formation of toner images using the corresponding one color toner with first to fifth development rollers 45 to 49 upon development of the electrostatic latent images. Print controller 100 accordingly causes first to fifth image formation units 10 to 14 to transfer the toner images, which are formed on the outer circumferential surfaces of first to fifth photosensitive drums 30 to 34, to the outer circumferential surface of transfer belt 73 in transfer unit 15 so that the yellow toner image, magenta toner image, cyan toner image, black toner image, and clear toner image are layered in this order. In this case, print controller 100 conveys the five color toner images on the outer circumferential surface of transfer belt 73 to the secondary transfer position by the rotation of transfer belt 73 in the other rotation direction. The print controller also conveys print medium 5 to the secondary transfer position through the medium feed conveyance path. Print controller 100 accordingly transfers the five color toner images on the outer circumferential surface of transfer belt 73 to the surface of print medium 5 and delivers print medium 5, with the transferred toner images, to fixation unit 16 while print medium 5 is subsequently conveyed so as to be sandwiched between transfer belt 73 and secondary transfer roller 79. Print controller 100 then causes fixation unit 16 to heat and press print medium 5 while print medium 5 is conveyed so as to be sandwiched between heat roller 86 and press roller 87, which melts all at once the five color toner images and fixes them to the surface of print medium 5 to form a color print image. Print controller 100 then causes print medium 5, with the formed print image, to be conveyed to medium ejection port 2CY through the medium ejection conveyance path and ejected to medium delivery unit 2CX. Print controller 100 accordingly can deliver print medium 5, with the color print image formed on the surface, to a user through medium delivery unit 2CX.

(1-3) Constitution of Toners

In color printer 1, four color toners of yellow, magenta, cyan, and black, among the five color toners of yellow, magenta, cyan, black, and clear, are used as basic colors for print image formation to express the four colors of yellow, magenta, cyan, and black, or other various colors in a print image. In color printer 1, a clear toner from the five color toners of yellow, magenta, cyan, black, and clear is used as a special color for print image formation to give a gloss to the entire print image and to particular areas. In the following description, the four color toners of yellow, magenta, cyan, and black, being basic colors for the print image formation, are referred to as a yellow toner, a magenta toner, a cyan toner, and a black toner, respectively. These four color toners are also individually, or collectively, referred to as basic color toner (s) when these toners do not need to be particularly distinguished from each other. In the following description, yellow, magenta, cyan, and black colors are also individually, or collectively, referred to as basic color (s) when these colors do not need to be particularly distinguished from each other. Furthermore, in the following description, a toner of clear is also referred to as a clear toner or a special color toner; and the clear toner, yellow toner, magenta toner, cyan toner, and black toner are also individually, or collectively, referred to as toner (s) when these toners do not need to be particularly distinguished from each other.

To express the various colors in a print image, the basic color toners each need to be produced so as to be easily mixed with each other when melted by heating. That is, the basic color toners need to be produced to express their original colors (i.e., their single basic color) in the areas with no overlap with other basic color toners when melted by heating on the surface of print medium 5 with fixation unit 16 and to express colors (i.e., mixed colors obtained by mixing two or more basic colors at a predetermined ratio) other than the basic colors by the mixing of colors in the areas with an overlap with at least one of the other basic color toners. The clear toner, however, if produced so as to be easily mixed with the basic color toners when melted by heating, may be mixed with one or more basic color toners in the boundary with the basic color toners (i.e., in the areas where the clear toner is contiguous to the basic color toners in the direction parallel to the surface of print medium 5) to produce color blurring in the boundary when the clear toner is heated and melted together with the basic color toners on the surface of print medium 5 by fixing unit 16. Accordingly, the clear toner needs to be produced so as to be hardly mixed with any of the basic color toners when melted.

Here, the various parameters that indicate the properties of a toner include a parameter that indicates the solubility of toners when the toner is melted by heating. This parameter is called a solubility parameter. The solubility parameter is used as a measure to express the intermolecular force of the substances. The solubility parameter takes on different values depending on the type of resin being used as a base material (hereinafter also referred to as a base) of the toner. Toner having a relatively large value of the solubility parameter expresses water-like properties when melted, while toner having a relatively small value of the solubility parameter expresses oil-like properties when melted. Accordingly, a smaller difference in the value of the solubility parameter between different toners results in a larger solubility, and thus these different toners are easily mixed with (dissolve in) each other. When the difference in the value of the solubility parameter between different toners is larger to some extent, these toners have a tendency of being difficult to mix with each other, like water and oil, when melted.

In a first embodiment, color blurring (i.e., the blurring of clear and basic colors or mixed colors of two or more basic colors in the boundary between the clear toner and the basic color toners) may be prevented in a print image when the yellow toner, magenta toner, cyan toner, and black toner have a value of the solubility parameter different from that of the clear toner. Thus in the first embodiment, the yellow toner, magenta toner, cyan toner, and black toner are each produced using the same resin as the base in order to determine whether color blurring occurs in the print image according to the value of the solubility parameter of the toners. In the first embodiment, a clear toner is produced with a different type of resin as the base from the resin of the base of the basic color toners (yellow toner, magenta toner, cyan toner, and black toner), and a clear toner is produced as the base with the same resin as the resin of the base of the basic color toners. In the following description, of the two types of clear toners, the one produced using a different type of resin from the resin of the base of the basic color toners is also referred to as a first clear toner, while the other produced using as the base the same type of resin as the resin of the base of the basic color toners is also referred to as a second clear toner. These clear toners are also simply referred to as a clear toner when there is no particular need to distinguish these clear toners from each other.

In the first embodiment, a yellow toner, magenta toner, cyan toner, and black toner each are actually produced by, for example, the following emulsion polymerization method as a toner production procedure. In the emulsion polymerization method, for example, for yellow toner production, primary particles being a styrene acrylic resin are first produced as a base from styrene, acrylic acid, and methylmethacrylic acid by the styrene acrylic copolymerization. In the emulsion polymerization method, a base toner is next produced by mixing the primary particles (i.e., the styrene acrylic resin) with, for example, a pigment yellow (PY)-74 as a colorant and, for example, stearyl stearate as a wax to cause aggregation. In the emulsion polymerization method, to 100 parts by weight of the base toner, for example, 1.0 part by weight of hydrophobic silica fine powder "R-972" (produced by Nippon Aerosil Co., Ltd.), 1.5 parts by weight of hydrophobic silica fine powder "RY-50" (produced by Nippon Aerosil Co., Ltd.), and titanium oxide being conductive fine powder are next added as external additives, and mixed with a mixer (e.g., a Henschel mixer produced by Mitsui Mining Co., Ltd.). The mixture is then screened to produce a yellow toner.

In the first embodiment, a magenta toner, cyan toner, and black toner are produced using as abase the same styrene acrylic resin as the base of the yellow toner, and in the same manner as in the production of the yellow toner except that the colorants are different. To produce the magenta toner, for example, pigment red (PR)-122 is used as a magenta toner colorant instead of the yellow toner colorant (i.e., pigment yellow (PY)-74 in this case). To produce the cyan toner, for example, pigment blue (PB)-15:3 is used as a cyan toner colorant instead of the yellow toner colorant. To further produce the black toner, for example, carbon black is used as a black toner colorant instead of the yellow toner colorant. In the first embodiment, the second clear toner is also produced by the emulsion polymerization method using as abase the same styrene acrylic resin as the base of the basic color toners (yellow toner, magenta toner, cyan toner, and black toner) in the same manner as in the production of the basic color toners except that no colorant is particularly used.

In the first embodiment, the first clear toner is produced by, for example, the following pulverization method as a toner production procedure. In the pulverization method, for example, 100 parts by weight of a polyester resin (number average molecular weight Mn=3700, glass transition temperature Tg=62° C.) as a base is first mixed well with, for example, 1 part by weight of a salicylic acid complex as a charge control agent and 10 parts by weight of a release agent (glass transition temperature Tg=100° C.) under stirring with a mixer (e.g., a Henschel mixer produced by Mitsui Miike Chemical Engineering Machinery, Co., Ltd.) to produce a mixture. In the pulverization method, the mixture is next melted by heating and kneaded at a temperature of 100° C. for about three hours with an open roll-type continuous kneading machine (e.g., KNEADEX produced by Mitsui Mining Co., Ltd.) and then allowed to cool to room temperature. The resulting kneaded material is pulverized with a collision plate-type mill (e.g., Dispersion Separator produced by Nippon Pneumatic Mfg. Co., Ltd.) using jet stream, and is subsequently classified with an aerodynamic rotor-rotatable dry type air classifier (e.g., Micron Separator produced by Hosokawa Micron Corporation) using the centrifugal force to produce a base toner. In the pulverization method, to 100 parts by weight of the base toner, the same external additives as in the production of the basic color toners mentioned above are subsequently added and mixed with a mixer (e.g., a Henschel mixer produced by Mitsui Mining Co., Ltd.). The mixture is then screened to produce a first clear toner.

In the first embodiment, the value of the solubility parameter is determined by the measurement procedure called a clouding point drop method described below for each of the yellow toner, magenta toner, cyan toner, black toner, first clear toner, and second clear toner thus produced. In this measurement procedure, a poor solvent is added dropwise in aliquots to a solution of the toner in a good solvent and the amount (i.e., the volume) of the poor solvent required for being cloudy is measured. This step is separately carried out using a first poor solvent having a relatively smaller solubility parameter and a second poor solvent having a relatively larger solubility parameter. On the basis of the measured results, the solubility parameter of the toner is determined.

As described in more detail, in this measurement procedure, for example, to measure the solubility parameter of the yellow toner, 0.5 g of the yellow toner is first dissolved in 10 ml of acetone in a 100 ml beaker to produce a solution. Two beakers containing the solution are provided. In this measurement procedure, the first poor solvent, such as n-hexane, is added dropwise to one of the beakers using a burette while the solution is stirred, and the volume of the first poor solvent required for the solution to become cloudy is measured. In the measurement procedure, the second poor solvent, such as deionized water, is added dropwise to the other beaker using a burette while the solution is stirred, and the volume of the second poor solvent required for the solution to become cloudy is measured. In the first embodiment, each of the measurements is carried out in a thermostatic chamber at 20° C.

In the first embodiment, the solubility parameter $\delta y$ $(cal/cm^3)^{1/2}$ of the yellow toner is subsequently calculated from volume Vml (in milliliters, ml) of the first poor solvent and volume Vmh (in milliliters, ml) of the second poor solvent measured above, as well as the solubility parameter δml $(cal/cm^3)^{1/2}$ of the first poor solvent and the solubility parameter δmh $(cal/cm^3)^{1/2}$ of the second poor solvent according to equation (1).

$$\delta_y = \frac{Vml^{\frac{1}{2}} \cdot \delta ml + Vmh^{\frac{1}{2}} \cdot \delta mh}{Vml^{\frac{1}{2}} + Vmh^{\frac{1}{2}}} \quad (1)$$

In the first embodiment, the solubility parameter of the magenta toner, cyan toner, and black toner, the solubility parameter of the first clear toner, and the solubility parameter of the second clear toner are also obtained in the same manner as in the yellow toner. As a result, solubility parameters δy, δm, δc, and δk of the yellow toner, magenta toner, cyan toner, and black toner are 16.4, 16.5, 16.8, and 16.2 $(cal/cm^3)^{1/2}$, respectively. Solubility parameters δcl1 and δcl2 of the first and second clear toners are 10.1 and 16.1 $(cal/cm^3)^{1/2}$, respectively.

In the first embodiment, the yellow toner, magenta toner, cyan toner, and black toner, and second clear toner each are produced to have substantially the same value of solubility parameters δy, δm, δc, δk, and δcl2 by using the same styrene acrylic resin as the base. Although the yellow toner, magenta toner, cyan toner, and black toner, and second clear toner each are produced using the same styrene acrylic resin as the base in the first embodiment, there are small differences among the values of solubility parameters δy, δm, δc, δk, and δcl2. These differences are within the error of measurement and the values of solubility parameters δy, δm, δc, δk, and δcl2 are considered substantially the same. In the first embodiment, the first clear toner is produced using as the base a polyester resin different from the base of the basic color toners and the second clear toner. The first clear toner is thus produced to have a value of solubility parameter δcl1 that is relatively largely different from the values of solubility parameters δcl2, δy, δm, δc, and δk of the basic color toners and the second clear toner.

(1-4) Evaluation Test

The evaluation test for evaluating whether color blurring occurs in a print image is next described. The evaluation test is carried out using the yellow toner, magenta toner, cyan toner, and black toner as the basic color toners, together with the first clear toner having a value of the solubility parameter different from those of the basic color toners, and the second clear toner having substantially the same value of the solubility parameter as those of the basic color toners. In the evaluation test, a print image is formed on print medium 5 with color printer 1 mentioned above to evaluate whether color blurring occurs in the print image. In the evaluation test, for example, A4 size white plain paper (for example, Excellent white paper (basis weight=80 $g/m^2$, PPR-CA4NA, 210 mm in shorter side×297 mm in longer side) is used as print medium 5 produced by Oki Data Corporation) in order to facilitate the determination of whether color blurring occurs in the boundary between the clear toner and the basic color toners.

In the evaluation test, in order to facilitate the determination of whether color blurring occurs in the boundaries between the clear toner and the basic color toners, for example, the evaluation pattern (hereinafter also referred to as a first evaluation pattern) illustrated in FIG. 7 and FIGS. 8A to 8D is formed (i.e., printed) on the surface of the plain paper as a print image with color printer 1 while the plain paper is conveyed in such a conveyance position that one longer side is directed downstream of the conveyance direction.

Given that, in the first evaluation patter, on the surface of plain paper 5A, the basic color toners (black toner K, yellow toner Y1, cyan toner C1, magenta toner M1) are printed in first to eighth rectangular areas, and a clear toner is printed in a ninth area, which is the remaining area other than the first to eighth areas and the margin area.

More specifically, for example, the origin is the left corner downstream of the conveyance direction on the surface of plain paper 5A and the longer side and shorter side are the X-axis and Y-axis respectively in the first evaluation pattern here. The rectangular first area ranges from 1.0 cm to 14.0 cm positions in the X-axis direction and from 1.0 cm to 5.0 cm positions in the Y-axis direction on the surface of plain paper 5A. The rectangular first area is provided as an adhesion area of black toner K1 (i.e., the area that is solidly filled with only black toner K1). In the first evaluation pattern, for example, the rectangular second area ranges from 16.0 cm to 29.0 cm positions in the X-axis direction and from 1.0 cm to 5.0 cm positions in the Y-axis direction on the surface of plain paper 5A. The rectangular second area is provided as an adhesion area of yellow toner Y1 (i.e., the area that is solidly filled with only yellow toner Y1). Furthermore, in the first evaluation pattern, for example, the rectangular third area ranges from 1.0 cm to 14.0 cm positions in the X-axis direction and from 6.0 cm to 10.0 cm positions in the Y-axis direction on the surface of plain paper 5A. The rectangular third area is provided as an adhesion area of magenta toner M1 (i.e., the area that is solidly filled with only magenta toner M1). Furthermore, in the first evaluation pattern, for example, the rectangular fourth area ranges from 16.0 cm to 29.0 cm positions in the X-axis direction and from 6.0 cm to 10.0 cm positions in the Y-axis direction on the surface of plain paper 5A. The rectangular fourth area is provided as an adhesion area of cyan toner C1 (i.e., the area that is solidly filled with only toner C1).

Furthermore, in the first evaluation pattern, for example, the rectangular fifth area ranges from 1.0 cm to 14.0 cm positions in the X-axis direction and from 11.0 cm to 15.0 cm positions in the Y-axis direction on the surface of plain paper 5A. The rectangular fifth area is provided as an adhesion area of cyan toner C1, magenta toner M1, and yellow toner Y1 (i.e., the area that is solidly filled with sequentially layered cyan toner C1, magenta toner M1, and yellow toner Y1). Furthermore, in the first evaluation pattern, for example, the rectangular sixth area ranges from 16.0 cm to 29.0 cm positions in the X-axis direction and from 11.0 cm to 15.0 cm positions in the Y-axis direction on the surface of plain paper 5A. The rectangular sixth area is provided as an adhesion area of magenta toner M1 and yellow toner Y1 (i.e., the area that is solidly filled with sequentially layered magenta toner M1 and yellow toner Y1). Furthermore, in the first evaluation pattern, for example, the rectangular seventh area ranges from 1.0 cm to 14.0 cm positions in the X-axis direction and from 16.0 cm to 20.0 cm positions in the Y-axis direction on the surface of plain paper 5A. The rectangular seventh area is provided as an adhesion area of cyan toner C1 and magenta toner M1 (i.e., the area that is solidly filled with sequentially layered cyan toner C1 and magenta toner M1). Furthermore, in the first evaluation pattern, for example, the rectangular eighth area ranges from 16.0 cm to 29.0 cm positions in the X-axis direction and from 16.0 cm to 20.0 cm positions in the Y-axis direction on the surface of plain paper 5A. The rectangular eighth area is provided as an adhesion area of cyan toner C1 and yellow toner Y1 (i.e., the area that is solidly filled with sequentially layered cyan toner C1 and yellow toner Y1).

In the first evaluation pattern, for example, the areas with a width of 5 mm in the top, bottom, left and right edges on the surface of plain paper 5A are used as margins. In other words, in the first evaluation pattern, no toner is applied to the areas with a width of 5 mm in the top, bottom, left and right edges on the surface of plain paper 5A. In the following description, the areas being the margins on the surface of plain paper 5A are also referred to as margin areas. In the first evaluation pattern, the ninth area on the surface of plain paper 5A, which is the remaining area other than the margin areas and the first to eighth areas (i.e., the area surrounding the first to eighth areas and between these first to eighth areas and the margin areas) is the adhesion area of first and second clear toners CL1 and CL2 (i.e., the area where only any one of first and second clear toners CL1 and CL2 is solidly filled in a manner contiguous to the basic color toners). It is noted that FIG. 7 illustrates the surface of plain paper 5A along with the first evaluation pattern on the surface. FIGS. 8A to 8D illustrate plain paper 5A along with the first evaluation pattern, as viewed in cross section. The cross sections are taken at the position of arrow A-A' (for example, the position of 4.0 cm in the Y-axis direction) indicated in FIG. 7, at the position of arrow B-B' (for example, the position of 9.0 cm in the Y-axis direction), at the position of arrow C-C' (for example, the position of 14.0 cm in the Y-axis direction), and at the position of arrow D-D' (for example, the position of 19.0 cm in the Y-axis direction) respectively in parallel to the X-axis direction.

The above color blurring that occurs in the print image arises from the temporal melting of the basic color toners and the clear toner on the surface of print medium 5 by heating and pressing these toners. In this evaluation test, the heating temperature and nip pressure are appropriately selected for when the basic color toners and the clear toner are heated and pressed as the first evaluation pattern on the surface of plain paper 5A. The heating temperature ranges from 170 to 180° C. during the heating of the basic color toners on the surface of a print medium with conventional color printers. However in the evaluation test, a wider range of temperatures, for example seven temperatures with 10° C. intervals in the range of from 150 to 210° C. (i.e., 150, 160, 170, 180, 190, 200, and 210° C.), are actually selected as the heating temperature for heating the basic color toners and the clear toners as the first evaluation pattern on the surface of plain paper 5A. With reference to the nip pressure, a pressure ranging from 2.0 to 3.0 kg/cm$^2$ during the pressing of basic color toners on the surface of a print medium is used with conventional color printers. However, in the evaluation test a wider range of pressures, for example six pressures with 0.5 kg/cm$^2$ intervals in the range of from 1.5 to 4.0 kg/cm$^2$ (i.e., 1.5, 2.0, 2.5, 3.0, 3.5, 4.0 kg/cm$^2$), are selected as the nip pressure for pressing the basic color toners and the clear toners as the first evaluation pattern on the surface of plain paper 5A. In the evaluation test, the selected seven heating temperatures are each combined with the selected six nip pressures and these combinations are provided as the conditions for heating and pressing the basic color toners and the clear toners with fixation unit 16 (hereinafter also referred to as the heat pressing conditions). In the evaluation test, the pattern formation conditions for forming the first evaluation pattern using the basic color toners (yellow toner Y1, magenta toner M1, cyan toner C1, and black toner K1) together with first clear toner CL1 and second clear toner CL2 on the surface of plain paper 5A are roughly classified into seven types according to the heating temperature, although each type includes several types of heat pressing conditions. In the following description, these seven types of pattern formation conditions are also referred to as first to seventh pattern formation conditions.

The first to seventh pattern formation conditions are specifically described here with reference to FIGS. 9 to 11. The first pattern formation conditions include six types of heat pressing conditions in combination with the heating temperature of 150° C. and the nip pressures of 1.5, 2.0, 2.5, 3.0, 3.5, and 4.0 kg/cm$^2$ when the basic color toners (yellow toner Y1, magenta toner M1, cyan toner C1, and black toner K1), and the first clear toner CL1, which is different from these toners in the value of the solubility parameter, are used to form the first evaluation pattern. The second clear toner CL2, which has substantially the same value of the solubility parameter as those of the basic color toners as described above, is most likely to be mixed with the basic color toners during the heating and pressing with fixation unit 16. The first pattern formation conditions thus include only one type of heat pressing conditions in combination with the heating temperature of 150° C. and the nip pressures of 2.5 kg/cm$^2$ when the basic color toners (Y1, M1, C1, and K1) and the second clear toner CL2 are used to form the first evaluation pattern.

The second pattern formation conditions include six types of heat pressing conditions in combination with the heating temperature of 160° C. and the nip pressures of 1.5, 2.0, 2.5, 3.0, 3.5, and 4.0 kg/cm$^2$ when the basic color toners (Y1, M1, C1, and K1), and the first clear toner CL1 are used to form the first evaluation pattern. The second pattern formation conditions also include only one type of heat pressing condition in combination with the heating temperature of 160° C. and the nip pressure of 2.5 kg/cm$^2$ when the basic color toners (Y1, M1, C1, and K1), and the second clear toner CL2 are used to form the first evaluation pattern. This is for the same reason as described in the first pattern formation conditions. In addition, the third to seventh pattern formation conditions are different from the first and second pattern formation conditions only in the heating temperature. The heat pressing conditions, and the others are the same as those in the first and second pattern formation conditions. It is noted that the heating temperatures in the third, fourth, and fifth pattern formation conditions are 170, 180, and 190° C., respectively. The heating temperatures in the sixth and seventh pattern formation conditions are 200 and 210° C., respectively.

In the first to seventh pattern formation conditions, the feeding speed of plain paper 5A when the toners are heated and pressed with fixation unit 16 is, for example, 140 mm/sec by linear velocity. This is for the feeding speed of plain paper 5A with heat roller 86 and press roller 87 during the heating and pressing of the toners while plain paper 5A is conveyed so as to be sandwiched between heat roller 86 and press roller 87. The linear velocity of 140 mm/sec refers to, for example, the velocity at which the first evaluation pattern can be formed on about 37 sheets per minute of A4 size plain paper 5A.

In the evaluation test, to form the first evaluation pattern on the surface of plain paper 5A according to these first to seventh pattern formation conditions, first to fifth toner cartridges 25 to 29 containing 100 g of first clear toner CL1, black toner K1, cyan toner C1, magenta toner M1, and yellow toner Y1, respectively, are installed in the corresponding first to fifth image formation units 10 to 14 in color printer 1, whereby first to fifth image formation units 10 to 14 are ready for the formation of toner images. In the evaluation test, color printer 1 is allowed to stand overnight (e.g., for 12 hours or more) in an environment with, for example, a temperature of 23° C. and a humidity of 55% (hereinafter also referred to as a pattern formation environment) for forming the first evaluation pattern on the surface of plain paper 5A.

In the evaluation test, the first evaluation pattern is accordingly formed on the surface of plain paper 5A using basic color toners (Y1, M1, C1, and K1), and first clear toner CL1 with color printer 1 according to the first pattern formation conditions under each of the above six types of heat pressing conditions for basic color toners (Y1, M1, C1, and K1), and first clear toner CL1. In the evaluation test, the first evaluation pattern is next formed on the surface of plain paper 5A using basic color toners (Y1, M1, C1, and K1), and the first clear toner CL1 with color printer 1 according to the second pattern formation conditions under each of the above six types of heat pressing conditions for basic color toners (Y1, M1, C1, and K1), and first clear toner CL1. In the evaluation test, the first evaluation pattern is subsequently formed on the surface of plain paper 5A using the basic color toners (Y1, M1, C1, and K1), and the first clear toner CL1 with color printer 1. Similarly, the third to seventh pattern formation conditions are sequentially formed under each of the six types of heat pressing conditions for the basic color toners (Y1, M1, C1, and K1), and the first clear toner CL1.

In the evaluation test, after completing the formation of all the first evaluation patterns using the basic color toners (Y1, M1, C1, and K1), and the first clear toner CL1, first to fifth image formation units 10 to 14 are returned to the state that existed before the installation of the corresponding first to fifth toner cartridges 25 to 29 in color printer 1. In the evaluation test, then second to fifth toner cartridges 26 to 29 containing 100 g of black toner K1, cyan toner C1, magenta toner M1, and yellow toner Y1, respectively, are installed again in the corresponding second to fifth image formation units 11 to 14 in color printer 1. In the evaluation test, first toner cartridge 25 containing 100 g of second clear toner CL2 is installed in first image formation unit 10 in color printer 1 in this case. In this way, first to fifth image formation units 10 to 14 are ready for the formation of toner images in color printer 1 in the evaluation test. Color printer 1 is then allowed to stand overnight (e.g., for 12 hours or more) in the pattern formation environment as described above.

In the evaluation test, the first evaluation pattern is accordingly formed on the surface of plain paper 5A using the basic color toners (Y1, M1, C1, and K1), and the second clear toner CL2 with color printer 1 according to the first pattern formation conditions under the above one type of heat pressing conditions for the basic color toners (Y1, M1, C1, and K1), and the second clear toner CL2. In the evaluation test, the first evaluation pattern is next formed on the surface of plain paper 5A using the basic color toners (Y1, M1, C1, and K1), and the second clear toner CL2 with color printer 1 according to the second pattern formation conditions under the above one type of heat pressing conditions for the basic color toners (Y1, M1, C1, and K1), and the second clear toner CL2. In the evaluation test, the first evaluation pattern is subsequently formed on the surface of plain paper 5A using the basic color toners (Y1, M1, C1, and K1), and the second clear toner CL2 with color printer 1. The pattern formation is similar to that of the third to seventh pattern formation conditions, formed sequentially under the one type of heat pressing conditions for the basic color toners (Y1, M1, C1, and K1), and the second clear toner CL2.

In the evaluation test, after completing the formation of all the first evaluation patterns using the basic color toners (Y1, M1, C1, and K1), and the second clear toner CL2, whether color blurring occurs is subsequently determined for all the first evaluation patterns formed using the basic color toners (Y1, M1, C1, and K1) together with the first clear toner CL1 and second clear toner CL2. In the evaluation test, the formation state of the first evaluation pattern on the surface of plain paper 5A is evaluated on the basis of the determination results. In the following description, the evaluation on the formation state of the first evaluation pattern on the surface of plain paper 5A according to the determination results of whether color blurring occurs is also referred to as a first evaluation.

In the evaluation test, whether color blurring occurs in the boundaries between the ninth area, which is the adhesion area of the clear toner, and the first to eighth areas, which are the adhesion areas of the basic color toners is visually determined in practice in the first evaluation patterns formed on the respective surfaces of sheets of plain paper 5A. As a result, in the evaluation test, when no color blurring is observed in any parts in the boundaries between the ninth area and the first to eighth areas in the first evaluation pattern, the formation state of the first evaluation pattern is evaluated as excellent. In the evaluation test, when unclear outlines of basic colors or mixed colors of two or more basic colors due to color blurring are observed in at least one or more parts in the boundaries between the ninth area and the first to eighth areas, which color blurring may be cause by, for example, the spreading and mixing of the basic color toners in the first to eighth areas into/with the clear toner in the ninth area in the first evaluation pattern, the formation state of the first evaluation pattern is evaluated as poor. In FIGS. 9 to 11, the results of this first evaluation are indicated in the column of the first evaluation: the case where the formation state of the first evaluation pattern is evaluated as excellent is given "O", and the case where the formation state of the first evaluation pattern is evaluated as poor is given "x".

In the evaluation test, the fixability of the toners to the surfaces of sheets of plain paper 5A is next determined for all the first evaluation patterns (i.e., the first evaluation patterns that have been tested for whether color blurring occurs) formed on the surfaces of the sheets of plain paper 5A. Before the way to determine the fixability of the toners carried out in the evaluation test is specifically described, the fixation of the toners, such as the basic color toners or the clear toner, to the surface of print medium 5, such as plain paper 5A, is described. First, when the toner adhering to the surface of print medium 5 is melted by heating and pressing with fixation unit 16, a first force that causes an attraction between the toner molecules and a second force that pulls the toner molecules from print medium 5 (i.e., that cause the toner molecules to enter the surface of print medium 5) are expected to act on the toner at the same time. A third force that pulls toner molecules from heat roller 86 (i.e., that causes the toner molecules to adhere to the surface of heat roller 86) is also expected to act on the toner. When the toner adhering to the surface of print medium 5 is melted by applying a suitable amount of heat to the toner through heating and pressing, the first to third forces act on the toner in a well-balanced manner and cause the toner to permeate only the surface of print medium 5. The toner is accordingly fixed to the surface in a preferable state with the form of the toner being substantially maintained at the time of the adhesion.

However, when the toner adhering to the surface of print medium 5 is, for example, melted by applying a relatively smaller amount of heat than a suitable amount of heat through heating and pressing, the second and third forces acting on the toner relatively decrease, which causes a fixation failure in which the toner adheres only to the surface of print medium 5 in the state of being easily separated from the surface. When such a fixation failure occurs, the toner on the surface of print medium 5 is gradually separated by friction with a hand, other print media 5, or the like. This results in a lower density of basic colors and mixed colors of two or more basic colors when the toner on the surface of print medium 5 expresses the basic colors or the mixed colors. When the toner adhering to the surface of print medium 5 is, for example, melted by applying, for example, a relatively larger amount of heat than a suitable amount of heat through heating and pressing, the second and third forces acting on the toner relatively increases. This causes the toner to permeate the surface of print medium 5 to some extent so that the toner is fixed to the surface, but this also causes the toner to adhere to the surface of heat roller 86. The toner adhering to the surface of heat roller 86, because of the rotation of heat roller 86 at this time, moves from the surface and becomes fixed to a different area from the original adhesion area on the surface of print medium 5 so to cause printing failure (hereinafter also referred to as hot offset).

In the evaluation test, whether hot offset occurs in the basic color toners and the clear toners is visually determined for all the first evaluation patterns formed on the respective surfaces of sheets of plain paper 5A. In the evaluation test, for example, whether fixation failure occurs is determined by measuring the fixation rate of the basic color toners to the surface of plain paper 5A according to the fixation rate measurement procedure, called a tape-peeling method, for all the first evaluation patterns formed on the respective surfaces of sheets of plain paper 5A. In the fixation rate measurement procedure, the density (hereinafter also referred to as a first density) of basic colors or mixed colors of two or more basic colors is measured at the density measurement position in each of the first to eighth areas, being the adhesion areas of the basic color toners in the first evaluation pattern on the surface of plain paper 5A, with a densitometer (e.g., X-rite 528 produced by X-Rite, Incorporated). The density measurement position is defined as, for example, the intersection position of a pair of diagonal lines in each area. Next, in the fixation rate measurement procedure, an adhesive tape (e.g., Scotch tape 810 produced by Sumitomo 3M Limited) is pasted at the density measurement position in each of the first to eighth areas in the first evaluation pattern on the surface of plain paper 5A. Thereafter, 500 g of a weight, for example, is moved back and forth once on the adhesive tape, and the adhesive tape is then peeled. The density (hereinafter also referred to as a second density) of the basic colors or mixed colors is measured again at the density measurement position in each of the first to eighth areas with the same densitometer.

In the fixation rate measurement procedure, the weight is moved only one reciprocating motion on the adhesive tape, for example, at a movement speed of about 10 mm/sec without adding any external force other than the own weight of the weight on the adhesive tape from right above when the weight is placed on the adhesive tape pasted on the first evaluation pattern on the surface of plain paper 5A. In the fixation rate measurement procedure, fixation rate FR of the basic color toner at the density measurement position for each of the first to eighth areas is calculated from first density OD1 and second density OD2 according to equation (2):

$$FR=OD2/OD1\times 100 \quad (2)$$

as the rate of change in density of the basic color toner between before attaching the adhesive tape and after peeling it. In the evaluation test, when fixation rate FR is 90% for all of the first to eighth areas in the first evaluation pattern formed on the surface of plain paper 5A, it is determined that no fixation failure of the basic color toners occurs in the first evaluation pattern on the surface of plain paper 5A. On the other hand, when in the evaluation test fixation rate FR is less than 90% for at least one of the first to eighth areas in the first evaluation pattern formed on the surface of plain paper 5A, it is determined that fixation failure of the basic color toner occurs in the first evaluation pattern on the surface of plain paper 5A. In the evaluation test, whether hot offset occurs and whether fixation failure occurs are determined in these ways. Of the first evaluation patterns formed on the respective surfaces of sheets of plain paper 5A, first evaluation patterns that are determined to have neither fixation failure of the basic color toners nor hot offset are evaluated as an excellent formation state. In the evaluation test, of the first evaluation patterns formed on the respective surfaces of sheets of plain paper 5A, first evaluation patterns that are determined to have a fixation failure of the basic color toners are evaluated as a poor formation state regardless of the generation of hot offset. In the evaluation test, of the first evaluation patterns formed on the respective surfaces of sheets of plain paper 5A, first evaluation patterns that are determined to have hot offset are further evaluated as a poor formation state regardless of generation of fixation failure of the basic color toners. In the following description, the evaluation on the formation state of the first evaluation pattern on the surface of plain paper 5A on the basis of whether a fixation failure occurs and whether a hot offset occurs is also referred to as a second evaluation. In FIGS. 9 to 11, the results of this second evaluation are indicated in the column of the second evaluation: the case where the formation state of the first evaluation pattern is evaluated as excellent is given "O" and the case where the formation state of the first evaluation pattern is evaluated as poor is given "x".

In the evaluation test, the first evaluation and the second evaluation are obtained in these ways for the first evaluation patterns formed on the respective surfaces of the sheets of plain paper 5A. On the basis of these evaluations, the formation state of each of the first evaluation patterns is comprehensively evaluated. That is, in the evaluation test, when the first evaluation pattern is rated as excellent in both the first evaluation and the second evaluation, the formation state of the first evaluation pattern is comprehensively evaluated as excellent. On the other hand, when the first evaluation pattern is rated as poor in at least one of the first evaluation and the second evaluation, the formation state of the first evaluation pattern is comprehensively evaluated as poor. In FIGS. 9 to 11, the results of this comprehensive evaluation are indicated in the column of the comprehensive evaluation: the case where the formation state of the first evaluation pattern is evaluated as excellent is given "O" and the case where the formation state of the first evaluation pattern is evaluated as poor is given "x".

The evaluation results (FIGS. 9 to 11) according to the evaluation test are described here. First, according to the evaluation test, when the first evaluation patterns are formed on the surface of plain paper 5A according to the first pattern formation conditions under the six types of heat pressing conditions for the basic color toners (Y1, M1, C1, and K1), and the first clear toner CL1, the first evaluation patterns are all rated as excellent in the first evaluation but poor in the second evaluation, and thus poor in the comprehensive evaluation. The evaluation test thus indicates that, when the basic color toners (Y1, M1, C1, and K1), together with the first clear toner CL1 are used for print image formation, the six types of heat pressing conditions with heating temperature 150° C. are not suitable for print image formation.

In the second evaluation of the evaluation test, the first evaluation patterns formed under the six types of heat pressing conditions are all rated as poor. This is because the heating temperature of 150° C. is relatively low and the amount of heat applied to the basic color toners (Y1, M1, C1, and K1), and the first clear toner CL1 through heating and pressing is accordingly relatively small, which causes the insufficient melting of the basic color toners (Y1, M1, C1, and K1), and the first clear toner CL1 to generate the fixation failure. In the evaluation test, the first evaluation patterns formed under the six types of heat pressing conditions are thus all rated as excellent in the first evaluation, which does not mean that no color blurring occurs because of the different values of the solubility parameter between the first clear toner CL1 and the basic color toners (Y1, M1, C1, and K1), but may mean that no color blurring occurs because of the insufficient melting of the toners and failure of mixing with each other.

According to the evaluation test, when the first evaluation pattern is formed on the surface of plain paper 5A according to the first pattern formation conditions under the one type of heat pressing conditions for the basic color toners (Y1, M1, C1, and K1), and the second clear toner CL2, the first evaluation pattern is also rated as excellent in the first evaluation but poor in the second evaluation, and thus poor in the comprehensive evaluation. The evaluation test thus indicates that the combination of toners of the basic color toners (Y1, M1, C1, and K1), and the second clear toner CL2 is not suitable for use in print image formation under the heat pressing conditions with a heating temperature of 150° C.

In this evaluation test, when the first evaluation pattern is formed with the basic color toners (Y1, M1, C1, and K1), together with second clear toner CL2, the first evaluation pattern is rated as poor in the second evaluation. This is because the heating temperature of 150° C. is relatively low, which causes the insufficient melting of the basic color toners (Y1, M1, C1, and K1), and second clear toner CL2 to generate a fixation failure in the same manner as in the case where the first clear toner CL1 is used. In the evaluation test, when the first evaluation pattern is formed with the basic color toners (Y1, M1, C1, and K1), together with second clear toner CL2, the first evaluation pattern is accordingly rated as excellent in the first evaluation. This also may be caused simply by the insufficient melting of the basic color toners (Y1, M1, C1, and K1), and second clear toner CL2 and a failure of them mixing with each other to avoid color blurring.

According to the evaluation test, when the first evaluation patterns are formed on the surface of plain paper 5A according to the second pattern formation conditions under the six types of heat pressing conditions for the basic color toners (Y1, M1, C1, and K1), and first clear toner CL1, the first evaluation patterns are rated as excellent in the first evaluation and also excellent in the second evaluation, and thus excellent in the comprehensive evaluation at any of nip pressures of 2.0, 2.5, 3.0, and 3.5 kg/cm$^2$. According to the evaluation test, however, the first evaluation patterns are rated as excellent in the first evaluation but poor in the second evaluation, and thus poor in the comprehensive evaluation at nip pressures of 1.5 and 4.0 kg/cm$^2$. The evaluation test thus indicates that, when the basic color toners (Y1, M1, C1, and K1), together with first clear toner CL1 are used for print image formation, four types of heat pressing conditions with a heating temperature of 160° C. and nip pressures of 2.0, 2.5, 3.0, and 3.5 kg/cm$^2$ prevent color blurring and are thus suitable for print image formation. Still, two types of heat pressing conditions with a temperature of 160° C. and nip pressures of 1.5 and 4.0 kg/cm$^2$ are not suitable for print image formation.

According to the evaluation test, when the first evaluation pattern is formed on the surface of plain paper 5A according to the second pattern formation conditions under the one type of heat pressing conditions for the basic color toners (Y1, M1, C1, and K1), and second clear toner CL2, the first evaluation pattern is rated as poor in both the first evaluation and the second evaluation, and thus poor in the comprehensive evaluation. The evaluation test indicates that, when the basic color toners (Y1, M1, C1, and K1), and second clear toner CL2 are used for print image formation, color blurring occurs in the print image even under the heat pressing conditions with a heating temperature of 160° C.

Moreover, according to the evaluation test, when the first evaluation patterns are formed on the surface of plain paper 5A according to the third pattern formation conditions under the six types of heat pressing conditions for the basic color toners (Y1, M1, C1, and K1), and first clear toner CL1, the first evaluation patterns are rated as excellent in the first evaluation and also excellent in the second evaluation, and thus excellent in the comprehensive evaluation at nip pressures of 2.0, 2.5, 3.0, and 3.5 kg/cm$^2$. According to the evaluation test, however, the first evaluation patterns are rated as excellent in the first evaluation but poor in the second evaluation, and thus poor in the comprehensive evaluation at nip pressures of 1.5 and 4.0 kg/cm$^2$. The evaluation test thus indicates that, when the basic color toners (Y1, M1, C1, and K1), together with first clear toner CL1 are used for print image formation, four types of heat pressing conditions with a heating temperature of 170° C. and nip pressures of 2.0, 2.5, 3.0, and 3.5 kg/cm$^2$ prevent color blurring and are thus suitable for print image formation. Still, there are two types of heat pressing conditions with a temperature of 170° C. and nip pressures of 1.5 and 4.0 kg/cm$^2$ that are not suitable for print image formation.

According to the evaluation test, when the first evaluation pattern is formed on the surface of plain paper 5A according to the third pattern formation conditions under the one type of heat pressing conditions for the basic color toners (Y1, M1, C1, and K1), and second clear toner CL2, the first evaluation pattern is rated as excellent in the second evaluation but poor in the first evaluation, and thus poor in the comprehensive evaluation. The evaluation test accordingly indicates that, when the basic color toners (Y1, M1, C1, and K1), and second clear toner CL2 are used for print image formation, color blurring occurs in the print image even under the heat pressing conditions with a heating temperature of 170° C.

Moreover, according to the evaluation test, when the first evaluation patterns are formed on the surface of plain paper 5A according to the fourth pattern formation conditions under the six types of heat pressing conditions for the basic color toners (Y1, M1, C1, and K1), and first clear toner CL1, the first evaluation patterns are rated as excellent in the first evaluation and also excellent in the second evaluation, and thus excellent in the comprehensive evaluation at nip pressures of 2.0, 2.5, 3.0, and 3.5 kg/cm$^2$. According to the evaluation test, the first evaluation patterns are rated as excellent in the first evaluation but poor in the second evaluation, and thus poor in the comprehensive evaluation at nip pressures of 1.5 and 4.0 kg/cm$^2$. The evaluation test thus indicates that, when the basic color toners (Y1, M1, C1, and K1), together with first clear toner CL1 are used for print image formation, four types of heat pressing conditions with a heating temperature of 180° C. and nip pressures of 2.0, 2.5, 3.0, and 3.5 kg/cm$^2$ prevent color blurring and are thus suitable for print image formation. Still, two types of heat pressing conditions, with a temperature of 180° C. and nip pressures of 1.5 and 4.0 kg/cm$^2$ are not suitable for print image formation.

According to the evaluation test, when the first evaluation pattern is formed on the surface of plain paper 5A according to the fourth pattern formation conditions under the one type of heat pressing conditions for the basic color toners (Y1, M1, C1, and K1), and second clear toner CL2, the first evaluation pattern is rated as excellent in the second evaluation but poor in the first evaluation, and thus poor in the comprehensive evaluation. The evaluation test thus indicates that, when the basic color toners (Y1, M1, C1, and K1), and second clear toner CL2 are used for the print image formation, color blurring occurs in the print image even under the heat pressing conditions with a heating temperature of 180° C.

Moreover, according to the evaluation test, when the first evaluation patterns are formed on the surface of plain paper 5A according to the fifth pattern formation conditions under the six types of heat pressing conditions for the basic color toners (Y1, M1, C1, and K1), and first clear toner CL1, the first evaluation patterns are rated as excellent in the first evaluation and also excellent in the second evaluation, and thus excellent in the comprehensive evaluation at nip pressures of 2.0, 2.5, and 3.0 kg/cm$^2$. According to the evaluation test, however, the first evaluation pattern is rated as excellent in the first evaluation but poor in the second evaluation, and thus poor in the comprehensive evaluation at nip pressures of 1.5, 3.5, and 4.0 kg/cm$^2$. The evaluation test thus indicates that, when the basic color toners (Y1, M1, C1, and K1), together with first clear toner CL1 are used for the print image formation, three types of heat pressing conditions with a heating temperature of 190° C. and nip pressures of 2.0, 2.5, and 3.0 kg/cm$^2$ prevent color blurring and are thus suitable for print image formation. Still, there are three types of heat pressing conditions with a temperature of 190° C. and nip pressures of 1.5, 3.5, and 4.0 kg/cm$^2$ are not suitable for print image formation.

According to the evaluation test, when the first evaluation pattern is formed on the surface of plain paper 5A according to the fifth pattern formation conditions under the one type of heat pressing conditions for the basic color toners (Y1, M1, C1, and K1), and second clear toner CL2, the first evaluation pattern is rated as excellent in the second evaluation but poor in the first evaluation, and thus poor in the comprehensive evaluation. The evaluation test thus indicates that, when the basic color toners (Y1, M1, C1, and K1), and second clear toner CL2 are used for print image formation, color blurring occurs in the print image even under the heat pressing conditions with a heating temperature of 190° C.

Moreover, according to the evaluation test, when the first evaluation patterns are formed on the surface of plain paper 5A according to the sixth pattern formation conditions under the six types of heat pressing conditions for the basic color toners (Y1, M1, C1, and K1), and first clear toner CL1, the first evaluation patterns are rated as excellent in the first evaluation and also excellent in the second evaluation, and thus excellent in the comprehensive evaluation at nip pressures of 2.0, 2.5, and 3.0 kg/cm$^2$. According to the evaluation test, however, the first evaluation patterns are rated as excellent in the first evaluation but poor in the second evaluation, and thus poor in the comprehensive evaluation at nip pressures of 1.5, 3.5, and 4.0 kg/cm$^2$. The evaluation test thus indicates that, when the basic color toners (Y1, M1, C1, and K1), together with first clear toner CL1 are used for print image formation, three types of heat pressing conditions with a heating temperature of 200° C. and nip pressures of 2.0, 2.5, and 3.0 kg/cm$^2$ prevent color blurring and are thus suitable for print image formation. Still, three types of heat pressing conditions with a temperature of 200° C. and nip pressures of 1.5, 3.5, and 4.0 kg/cm$^2$ are not suitable for print image formation.

First, according to the evaluation test, when the first evaluation pattern is formed on the surface of plain paper 5A according to the sixth pattern formation conditions under the one type of heat pressing conditions for the basic color toners (Y1, M1, C1, and K1), and second clear toner CL2, the first evaluation pattern is rated as poor in both the first evaluation and the second evaluation, and thus poor in the comprehensive evaluation. The evaluation test thus indicates that, when the basic color toners (Y1, M1, C1, and K1), and second clear toner CL2 are used for print image formation, color blurring occurs in the print image even under the heat pressing conditions with a heating temperature of 200° C.

Furthermore, according to the evaluation test, when the first evaluation patterns are formed on the surface of plain paper 5A according to the seventh pattern formation conditions under the six types of heat pressing conditions for the basic color toners (Y1, M1, C1, and K1), and first clear toner CL1, the first evaluation patterns are rated as excellent in the first evaluation but poor in the second evaluation, and thus poor in the comprehensive evaluation. The evaluation test thus indicates that, when the basic color toners (Y1, M1, C1, and K1), together with first clear toner CL1 are used for print image formation, the six types of heat pressing conditions with a heating temperature of 210° C. are not suitable for print image formation.

In the evaluation test, the first evaluation patterns formed under the six types of heat pressing conditions are all rated as poor in the second evaluation. This is because the heating temperature of 200° C. is relatively high, and the amount of heat applied to the basic color toners (Y1, M1, C1, and K1), and first clear toner CL1 through heating and pressing is accordingly relatively large, which causes the excessive melting of the basic color toners (Y1, M1, C1, and K1), and first clear toner CL1 to generate a hot offset. In the evaluation test, the first evaluation patterns formed under the six types of heat pressing conditions are all rated as excellent in the first evaluation, with no color blurring. This may be because the values of the solubility parameter of the basic color toners (Y1, M1, C1, and K1) are different from that of first clear toner CL1.

According to the evaluation test, when the first evaluation pattern is formed on the surface of plain paper 5A according to the seventh pattern formation conditions under the one type of heat pressing conditions for the basic color toners (Y1, M1, C1, and K1), and second clear toner CL2, the first evaluation pattern is rated as poor in both the first evaluation and the second evaluation, and thus poor in the comprehensive evaluation. The evaluation test thus indicates that, when the basic color toners (Y1, M1, C1, and K1), and second clear toner CL2 are used for print image formation, color blurring occurs in the print image even under the heat pressing conditions with a heating temperature of 210° C.

Therefore, the evaluation test indicates that the print image can be formed even using the basic color toners (i.e., yellow toner Y1, magenta toner M1, cyan toner C1, and black toner K1) together with first clear toner CL1 different from the basic color toners in the value of the solubility parameter. This evaluation test also indicates that, when the value of the solubility parameter δst (i.e., solubility parameters δy, δm, δc, δk) of the basic color toners (i.e., yellow toner Y1, magenta toner M1, cyan toner C1, and black toner K1) differs from the value of the solubility parameter δcl1 of first clear toner CL1 by 6.1 $(cal/cm^3)^{1/2}$ or more, as expressed by equation (3), $$|\delta st-\delta cl1|\geq 6.1 \quad (3)$$

The generation of color blurring can be avoided in the boundaries between the adhesion area of first clear toner CL1 and the adhesion areas of the basic color toners in the print image. This evaluation test further indicates that, when the print image is formed with the basic color toners (i.e., yellow toner Y1, magenta toner M1, cyan toner C1, and black toner K1) together with first clear toner CL1, a heating temperature Ft for the basic color toners and first clear toner CL1 with fixation unit 16 is set to a temperatures within the range of from 160 to 200° C., as expressed by equation (4):

$$160\leq Ft\leq 200 \quad (4)$$

and nip pressure Fp for the basic color toners and first clear toner CL1 with fixation unit 16 is set to a pressures within the range of from 2.0 to 3.0 $kg/cm^2$, as expressed by equation (5), $$2.0\leq Fp\leq 3.0 \quad (5)$$

Then the print image can be formed with the basic color toners and first clear toner CL1 being favorably fixed to the surface of print medium 5 (i.e., with sufficient fixability).

In this evaluation test, when the heating temperature and the nip pressure are relatively high in fixation unit 16, the amount of heat applied to the basic color toners and to the first clear toner CL1 relatively increases the heating and pressing of the basic color toners and of the first clear toner CL1, which may facilitate the melting of the basic color toners and first clear toner CL1 to easily generate hot offset. In this evaluation test, on the other hand, when the heating temperature and nip pressure are relatively low in fixation unit 16, the amount of heat applied to the basic color toners and to the first clear toner CL1 relatively decreases in the heating and pressing of the basic color toners and first clear toner CL1, which may cause difficulty in melting the basic color toners and first clear toner CL1 to easily generate a fixation failure (i.e., to decrease the fixability). In the evaluation test, when the solubility parameter, heating temperature, and nip pressure meet the requirements of equations (3) to (5) mentioned above, the amount of heat applied to the basic color toners and to the first clear toner CL1 in heating and pressing these toners becomes the optimum, which may prevent color blurring that is caused by, for example, the mixing of the basic color toners into first clear toner CL1, and at the same time, provides favorable fixability of the basic color toners and first clear toner CL1.

(1-5) Operation and Effects of First Embodiment

Color printer 1 with the above configuration forms a print image on the surface of print medium 5 using the basic color toners of yellow toner Y1, magenta toner M1, cyan toner C1, and black toner K1, each having substantially the same value of the solubility parameter, together with first clear toner CL1 which has a different solubility parameter than the Y1, M1, C1 and K1 toners. The difference, in solubility parameter, between first clear toner CL1 and each basic color toner is, for example, 6.1 $(cal/cm^3)^{1/2}$. Therefore, color printer 1 can avoid color blurring due to toner mixing in the boundaries between the first clear toner and the basic color toners when the basic color toners and the first clear toner CL1 adhering to the surface of print medium 5 are melted by heating and pressing. Color blurring is avoided by preventing first clear toner CL1 from being mixed with the basic color toners (Y1, M1, C1, and K1) which are provided adjacent to and in contact with the clear toner on the surface of print medium 5. Thus, color printer 1 can avoid color blurring in the boundaries between first clear toner CL1 and basic color toners (Y1, M1, C1, and K1).

Therefore, color printer 1 can prevent deterioration of the image quality of the print image.

Here, the values of the solubility parameter of the basic color toners (Y1, M1, C1, and K1), and first clear toner CL1 substantially depend on the type of resin as the base of these toners. In color printer 1, the basic color toners (Y1, M1, C1, and K1) that are produced with a styrene acrylic resin as the base and the first clear toner CL1 that is produced with a polyester resin as the base are used for print image formation. In color printer 1, the basic color toners (Y1, M1, C1, and K1) and first clear toner CL1 can be used for print image formation with little change in the value of the solubility parameter of these toners. Therefore, color printer 1, for example, can prevent a deterioration of the image quality due to color blurring in the print image before the basic color toners (Y1, M1, C1, and K1) and first clear toner CL1 in first to fifth toner cartridges 25 to 29 are used up for print image formation. In color printer 1, the heating temperature and the nip pressure with fixation unit 16 are set to temperatures ranging from 160 to 200° C. and pressures ranging from 2.0 to 3.0 $kg/cm^2$. These are the optimum ranges in using the basic color toners (Y1, M1, C1, and K1) and first clear toner CL1 for print image formation. Color printer 1 can thus form the print image on the surface of print medium 5 while the basic color toners (Y1, M1, C1, and K1), and first clear toner CL1 are favorably fixed to the surface of print medium 5. Color printer 1, accordingly, can also prevent the print image formed on the surface of print medium 5 from being deteriorated due to, for example, friction with other print media 5.

(2) Second Embodiment (2-1) Internal Configuration and Circuit Configuration of Color Printer A second embodiment of the invention is next described. In the second embodiment, color printer 1 according to the first embodiment described above is used. For the internal configuration and circuit configuration of color printer 1 here, reference is made to the internal configuration and circuit configuration of color printer 1 described above with reference to FIGS. 1 to 6. Repeating the description of these configurations is thus omitted here.

(2-2) Constitution of Toners

Next, the toners used for print image formation with color printer 1 are described. In the second embodiment, yellow toner Y1, magenta toner M1, cyan toner C1, and black toner K1 used in the first embodiment described above are used for print image formation as basic color toners. In the second embodiment, only first clear toner CL1 used in the first embodiment described above is used for print image formation as a clear toner. As described above in the first embodiment, second clear toner CL2 is found to be not suitable as a clear toner used for print image formation together with basic color toners (Y1, M1, C1, and K1). Thus, second clear toner CL2 is not used and only first clear toner CL1 is used in the second embodiment. Since the basic color toners (Y1, M1, C1, and K1), and first clear toner CL1 are already described in detail in the first embodiment, the description of these toners is omitted.

(2-3) Evaluation Test

In recent years, transfer paper for T-shirt printing as print medium 5 have been available in the market, resulting in more opportunities to form print images on the transfer paper with commercially-available color printers. In this transfer paper, for example, a coat layer being a resin layer having a uniform predetermined thickness is laminated on the entire surface of the paper, and the surface of the coat layer is a surface on which print images are formed. However, when print images are formed on the surface of the transfer paper (i.e., the surface of the coat layer) with commercially-available color printers, for example, the basic color toners of yellow toner, magenta toner, cyan toner, and black toner adhering to the surface of the transfer paper are heated and pressed. This may cause the mixing of melted basic color toners into the coat layer of the transfer paper to generate color blurring at the contours of the basic toners on the coat layer constituting the surface of the transfer paper. The evaluation test for evaluating whether color blurring occurs in a print image is accordingly described below. The evaluation test involves forming the print image on the surface of the transfer paper as print medium 5 with color printer 1 using the basic color toners (Y1, M1, C1, and K1) together with the first clear toner CL1 different from these toners in the value of the solubility parameter. First, A4 size transfer paper (e.g., EA-CR produced by Quick Art) is used as print medium 5 in the evaluation test. In this transfer paper, the surface of a coat layer, being a polyurethane resin layer laminated on the entire surface of the paper, is a surface on which the print image is formed. The value of the solubility parameter of the coat layer is 20.5 $(cal/cm^3)^{1/2}$.

In the evaluation test, in order to facilitate the determination of whether color blurring occurs at the outlines of the basic color toners (Y1, M1, C1, and K1), for example, the third evaluation pattern as illustrated in FIG. 12 and FIGS. 13A to 13D is formed (i.e., printed) on the surface of the transfer paper as a print image using the basic color toners (Y1, M1, C1, and K1) and first clear toner CL1 with color printer 1. The pattern is formed while the transfer paper is conveyed in color printer 1 in such a conveyance position that one longer side is directed downstream in the conveyance direction.

The third evaluation pattern formed on the surface of transfer paper 5B (i.e., the surface of coat layer 5BY on paper 5BX) as a print image is the same pattern as the first evaluation pattern described in the first embodiment, except for the position of the clear toner. Specifically, in the third evaluation pattern, the clear toner is provided directly on the surface of transfer paper 5B (i.e., coat layer 5BY of paper 5BX) covering the entire surface of the transfer paper except for the margin area. The basic color toners (Y1, M1, C1, and K1) having the same pattern as those of the first evaluation pattern are provided on the layer of the clear toner. That is, in the third evaluation pattern, the clear toner is provided not only at the ninth region as described in the first embodiment but also covers substantially the entire surface of the transfer paper, while preventing the basic color toners (Y1, M1, C1, and K1) from directly contacting with the surface of the paper (coat layer 5BY of paper 5BX).

In the evaluation test, as compared to the case where the third evaluation pattern is formed on the surface of transfer paper 5B using first clear toner CL1, the fourth evaluation pattern as illustrated in FIG. 14 and FIGS. 15A to 15D is also formed (i.e., printed) on the surface of transfer paper 5B as a print image using only the basic color toners (Y1, M1, C1, and K1) with color printer 1 while transfer paper 5B is conveyed in the same conveyance position. The fourth evaluation pattern is to facilitate the determination of whether color blurring occurs at the outlines of the basic color toners (Y1, M1, C1, and K1). For example, the fourth evaluation pattern does not have first clear toner CL1 in the third evaluation pattern. Otherwise, the other areas are the same as in the third evaluation pattern. A specific description of the fourth evaluation pattern is thus omitted.

In the first embodiment described above, the basic color toners (Y1, M1, C1, and K1) and first clear toner CL1 are found to be favorably fixed to the surface of print media 5 when the heating temperature ranges from 160° C. to 200° C. and the nip pressure ranges from 2.0 to 3.0 $kg/cm^2$ in fixation unit 16 during the print image formation on the surface of print media 5 using the basic color toners (Y1, M1, C1, and K1), and first clear toner CL1 with color printer 1. Therefore, the heating temperatures for heating the toners with fixation unit 16 are the five temperatures of 160, 170, 180, 190, and 200° C. in the evaluation test. The nip pressures for pressing the toners with fixation unit 16 are the three pressures of 2.0, 2.5, and 3.0 $kg/cm^2$ in the evaluation test.

In addition, in the evaluation test, the selected five heating temperatures are each combined with the selected three nip pressures and these combinations are provided as heat pressing conditions in fixation unit 16. In the evaluation test, the pattern formation conditions for forming the first and fourth evaluation patterns on the surface of transfer paper 5B are roughly classified into five types according to the heating temperature, although each type includes several types of heat pressing conditions. In the following description, these five types of pattern formation conditions are also referred to as tenth to fourteenth pattern formation conditions.

The tenth to fourteenth pattern formation conditions are specifically described here with reference to FIGS. 16 to 17. The tenth pattern formation conditions include three types of heat pressing conditions for forming the third evaluation pattern using the basic color toners (Y1, M1, C1, and K1), and first clear toner CL1 different from these toners in the value of the solubility parameter, in combination with the heating temperature of 160° C. and the nip pressures of 2.0, 2.5, 3.0 $kg/cm^2$. The tenth pattern formation conditions also include three types of heat pressing conditions for forming the fourth evaluation pattern using only the basic color toners (Y1, M1, C1, and K1) in combination of the heating temperature of 160° C. and the nip pressures of 2.0, 2.5, 3.0 $kg/cm^2$.

The eleventh pattern formation conditions include three types of heat pressing conditions for forming the third evaluation pattern using only the basic color toners (Y1, M1, C1, and K1), and first clear toner CL1 in combination with the heating temperature of 170° C. and the nip pressures of 2.0, 2.5, 3.0 $kg/cm^2$. The eleventh pattern formation conditions also include three types of heat pressing conditions for forming the fourth evaluation pattern using only the basic color toners (Y1, M1, C1, and K1) in combination with the heating temperature of 170° C. and the nip pressures of 2.0, 2.5, 3.0 $kg/cm^2$. In addition, the twelfth to fourteenth pattern formation conditions are different from the tenth and eleventh pattern formation conditions only in terms of the heating temperature as the heat pressing conditions, and the others are the same as in the tenth and eleventh pattern formation conditions. The heating temperatures in the twelfth, thirteenth, and fourteenth pattern formation conditions are 180, 190, and 200° C., respectively. In the tenth to fourteenth pattern formation conditions, the feeding speed of transfer paper 5B when the toners are heated and pressed with fixation unit 16 is 140 mm/sec by linear velocity in the same manner as in the first embodiment described above.

In the evaluation test, to form the third evaluation pattern on the surface of transfer paper 5B according to the tenth to fourteenth pattern formation conditions, first to fifth toner cartridges 25 to 29 containing 100 g of first clear toner CL1, black toner K1, cyan toner C1, magenta toner M1, and yellow toner Y1 respectively are also first installed in the corresponding first to fifth image formation units 10 to 14 in color printer 1. They are then allowed to stand overnight (e.g., for 12 hours or more) in the pattern formation environment in the same manner as in the first embodiment described above. In the evaluation test, the third evaluation pattern is accordingly formed on the surface of transfer paper 5B using the basic color toners (Y1, M1, C1, and K1), and first clear toner CL1 with color printer 1 according to the tenth pattern formation conditions under each of the above three types of heat pressing conditions for the basic color toners (Y1, M1, C1, and K1), and first clear toner CL1. That is, in this evaluation test, the third evaluation pattern is formed such that first clear toner CL1 covers the surface of the transfer paper 5B (i.e., coat layer 5BY) and thus the basic color toners (Y1, M1, C1, and K1) are not directly in contact with the surface of transfer paper 5B (i.e., coat layer 5BY).

Next, in the evaluation test, the third evaluation pattern is accordingly formed on the surface of transfer paper 5B using the basic color toners (Y1, M1, C1, and K1), and first clear toner CL1 with color printer 1 according to the eleventh pattern formation conditions under each of the above three types of heat pressing conditions for the basic color toners (Y1, M1, C1, and K1) and first clear toner CL1. In the evaluation test, the third evaluation pattern is subsequently formed on the surface of transfer paper 5B using the basic color toners (Y1, M1, C1, and K1), and first clear toner CL1 with color printer 1, similarly according to the twelfth to fourteenth pattern formation conditions sequentially under each of the three types of heat pressing conditions for the basic color toners (Y1, M1, C1, and K1), and first clear toner CL1.

In the evaluation test, after completing the formation of all the third evaluation patterns using the basic color toners (Y1, M1, C1, and K1), and first clear toner CL1, first to fifth image formation units 10 to 14 are returned to the state before the installation of the corresponding first to fifth toner cartridges 25 to 29 in color printer 1. In the evaluation test, second to fifth toner cartridges 26 to 29 containing 100 g of black toner K1, cyan toner C1, magenta toner M1, and yellow toner Y1 respectively are then installed again in the corresponding second to fifth image formation units 11 to 14 in color printer 1, whereby only second to fifth image formation units 11 to 14 are ready for the formation of toner images. Color printer 1 is then allowed to stand overnight (e.g., for 12 hours or more) in the pattern formation environment as described above.

In the evaluation test, the fourth evaluation pattern is accordingly formed on the surface of transfer paper 5B using the basic color toners (Y1, M1, C1, and K1) with color printer 1 according to the tenth pattern formation conditions under each of the above three types of heat pressing conditions for the basic color toners (Y1, M1, C1, and K1). In the evaluation test, the fourth evaluation pattern is next formed on the surface of transfer paper 5B using the basic color toners (Y1, M1, C1, and K1) with color printer 1 according to the eleventh pattern formation conditions under each of the above three types of heat pressing conditions for the basic color toners (Y1, M1, C1, and K1). In the evaluation test, the fourth evaluation pattern is subsequently formed on the surface of transfer paper 5B using the basic color toners (Y1, M1, C1, and K1) with color printer 1, similarly according to the twelfth to fourteenth pattern formation conditions sequentially under each of the three types of heat pressing conditions for the basic color toners (Y1, M1, C1, and K1).

In the evaluation test, after completing the formation of all the fourth evaluation patterns using the basic color toners (Y1, M1, C1, and K1), for example, whether color blurring occurs at the outline of each of the first to eighth areas, being the adhesion areas of the basic color toners, is then visually determined for all the first and fourth evaluation patterns formed this time. In the evaluation test, the formation state of the first and fourth evaluation patterns on the surface of transfer paper 5B is evaluated on the basis of the determination results. Specifically, in the evaluation test, when no color blurring is observed in any part at the outlines of the first to eighth areas on coat layer 5BY of transfer paper 5B in the third or fourth evaluation pattern, the formation state of the first or fourth evaluation pattern is evaluated as excellent. In the evaluation test, when unclear outlines of the basic colors or of mixed colors due to color blurring are observed in at least one or more parts at the contours of the first to eighth areas on coat layer 5BY of transfer paper 5B, the formation state of the first or fourth evaluation pattern is evaluated as poor. The color blurring may be cause by, for example, the mixing and spreading of the basic color toners in the first to eighth areas into/with coat layer 5BY of transfer paper 5B in the first or fourth evaluation pattern. In FIGS. 16 and 17, the results of this first evaluation are indicated in the column of the first evaluation: the case where the formation state of the first or fourth evaluation pattern is evaluated as excellent is given "O", and the case where the formation state of the first or fourth evaluation pattern is evaluated as poor is given "x".

In the evaluation test, whether fixation failure and hot offset occur is next determined in the same manner as in the first embodiment described above for all the first and fourth evaluation patterns that have tested for whether color blurring occurs. As tested for whether hot offset and fixation failure occur, of the first and fourth evaluation patterns formed on the respective surfaces of sheets of transfer paper 5B, the first and fourth evaluation patterns that are determined to have neither a fixation failure of the basic color toners nor a hot offset are evaluated as an excellent formation state in the evaluation test. In the evaluation test, of the first and fourth evaluation patterns formed on the respective surfaces of sheets of transfer paper 5B, the first and fourth evaluation patterns that are determined to have a fixation failure of the basic color toners are evaluated as a poor formation state regardless of the generation of hot offset. In the evaluation test, of the first and fourth evaluation patterns formed on the respective surfaces of sheets of transfer paper 5B, the first and fourth evaluation patterns that are determined to have hot offset are evaluated as a poor formation state regardless of the generation of a fixation failure of the basic color toners. In FIGS. 16 and 17, the results of this second evaluation are indicated in the column of the second evaluation: the case where the formation state of the first or fourth evaluation pattern is evaluated as excellent is given "O", and the case where the formation state of the first or fourth evaluation pattern is evaluated as poor is given "x".

In the evaluation test, the first evaluation and the second evaluation are obtained in these ways for the first and fourth evaluation patterns formed on the respective surfaces of sheets of transfer paper 5B. On the basis of these evaluations, the formation state of each of the first and fourth evaluation patterns is comprehensively evaluated in the same manner as in the first embodiment described above. In FIGS. 16 and 17, the results of this comprehensive evaluation are indicated in the column of the comprehensive evaluation: the case where the formation state of the first or fourth evaluation pattern is evaluated as excellent is given "O", and the case where the formation state of the first or fourth evaluation pattern is evaluated as poor is given "x".

The evaluation results (FIGS. 16 to 17) according to the evaluation test are described here. First, according to the evaluation test, when the third evaluation patterns are formed on the surface of transfer paper 5B using the basic color toners (Y1, M1, C1, and K1) together with the first clear toner CL1, which has a different value of solubility parameter from that of the basic color toners, the third evaluation patterns are rated as excellent in both the first evaluation and the second evaluation and thus are excellent in the comprehensive evaluation under any of the heat pressing conditions.

According to the evaluation test, when the fourth evaluation patterns are formed on the surface of transfer paper 5B using only the basic color toners (Y1, M1, C1, and K1), the fourth evaluation patterns are rated as excellent in the first evaluation but poor in the second evaluation, and thus are poor in the comprehensive evaluation under any of the heat pressing conditions.

This evaluation test accordingly indicates that when the print image is formed on the surface of transfer paper 5B (i.e., the surface of coat layer 5BY) using only the basic color toners (i.e., yellow toner Y1, magenta toner M1, cyan toner C1, and black toner K1), color blurring occurs at the outlines of the adhesion areas of the basic color toners (i.e., yellow toner Y1, magenta toner M1, cyan toner C1, and black toner K1) on the coat layer 5BY constituting the surface of transfer paper 5B. This may be because the basic color toners (i.e., yellow toner Y1, magenta toner M1, cyan toner C1, and black toner K1) are in contact with coat layer 5BY of transfer paper 5B, and the value of solubility parameter δst (i.e., solubility parameters δy, δm, δc, δk) of the basic color toners (i.e., yellow toner Y1, magenta toner M1, cyan toner C1, and black toner K1) and the value of solubility parameter δpa of coat layer 5BY of transfer paper 5B have only a difference equal to, or less than, 4.3 $(cal/cm^3)^{1/2}$ as expressed by equation (6).

$$|\delta pa-\delta st|\leq 4.3 \quad (6)$$

This causes the basic color toners (i.e., yellow toner Y1, magenta toner M1, cyan toner C1, and black toner K1) to mix into coat layer 5BY and to spread out from the outlines thereof, when the basic toners melt on the surface of transfer paper 5B.

This evaluation test, on the other hand, indicates that, when first clear toner CL1 is firstly formed on the surface of transfer paper 5B (i.e., the surface of coat layer 5BY) and then the basic color toners (i.e., yellow toner Y1, magenta toner M1, cyan toner C1, and black toner K1) are formed on the first clear toner CL1, no color blurring occurs at the outlines of the basic color toners (i.e., yellow toner Y1, magenta toner M1, cyan toner C1, and black toner K1) on coat layer 5BY of transfer paper 5B. Since first clear toner CL1 adhere to the peripheries of the adhesion areas of the basic color toners (i.e., yellow toner Y1, magenta toner M1, cyan toner C1, and black toner K1) on the surface of transfer paper 5B (i.e., the surface of coat layer 5BY) in this case, the basic color toners (i.e., yellow toner Y1, magenta toner M1, cyan toner C1, and black toner K1) are adjacent to first clear toner CL1 on the transfer paper 5BY but not adjacent to coat layer 5BY on transfer paper 5B.

The value of solubility parameter δcl1 of first clear toner CL1 differs from the value of solubility parameter δst (i.e., solubility parameters δy, δm, δc, δk) of the basic color toners (i.e., yellow toner Y1, magenta toner M1, cyan toner C1, and black toner K1) by 6.1 $(cal/cm^3)^{1/2}$ or more, as expressed by equation (3) described above. The value of solubility parameter δcl1 of first clear toner CL1 differs from the value of solubility parameter δpa of the contiguous coat layer 5BY of transfer paper 5B by 10.4 $(cal/cm^3)^{1/2}$, as expressed by equation (7).

$$|\delta pa-\delta cl1|=10.4 \quad (7)$$

That is, the value of solubility parameter δcl1 of first clear toner CL1 also differs from the value of solubility parameter δpa of coat layer 5BY by 6.1 $(cal/cm^3)^{1/2}$ or more, as expressed by equation (8):

$$|\delta pa-\delta cl|\geq 6.1 \quad (8)$$

in the same manner as in the value of solubility parameter δst (i.e., solubility parameters δy, δm, δc, δk) of the basic color toners (i.e., yellow toner Y1, magenta toner M1, cyan toner C1, and black toner K1). This evaluation test, accordingly, suggests that, since first clear toner CL1 is interposed between the basic color toners (i.e., yellow toner Y1, magenta toner M1, cyan toner C1, and black toner K1) and coat layer 5BY of transfer paper 5B to function as a partition at outlines of the basic color toners, first clear toner CL1 prevents the basic color toners (i.e., yellow toner Y1, magenta toner M1, cyan toner C1, and black toner K1) from being mixed into, not only first clear toner CL, but also coat layer 5BY. This evaluation test also confirms that first clear toner CL1 is not mixed with coat layer 5BY of transfer paper 5B even at the outline of the clear toner CL1 (i.e., the boundary between first clear toner CL1 and the margin areas in the third evaluation pattern) from the difference between the values of solubility parameters δcl1 and δpa of first clear toner CL1 and coat layer 5BY of transfer paper 5B.

This evaluation test further indicates that, when heating temperature Ft is within the range expressed by equation (4) above and the nip pressure is within the range expressed by equation (5) above in fixation unit 16, the print image can be formed with the basic color toners (i.e., yellow toner Y1, magenta toner M1, cyan toner C1, and black toner K1) and the first clear toner CL1 being favorably fixed to the surface of transfer paper 5B (i.e., with sufficient fixability).

(2-4) Operation and Effects of Second Embodiment

With the above constitution, color printer 1 forms a print image on the surface of transfer paper 5B (i.e., the surface of coat layer 5BY) using yellow toner Y1, magenta toner M1, cyan toner C1, and black toner K1, each having substantially the same value of the solubility parameter, together with first clear toner CL1 which has a different solubility parameter value than that of the basic color toners by, for example, 6.1 $(cal/cm^3)^{1/2}$ so that the first clear toner CL1 is contiguous to the basic color toners (Y1, M1, C1, and K1). Therefore, in color printer 1, when the basic color toners (Y1, M1, C1, and K1) and first clear toner CL1 adhering to the surface of print medium 5 are melted by heating and pressing, first clear toner CL1 melted on the surface of transfer paper 5B can prevent the melted basic color toners (Y1, M1, C1, and K1) from spreading out from the outlines thereof into coat layer 5BY. This can avoid color blurring in or at the outlines of the basic color toners (Y1, M1, C1, and K1) on coat layer 5BY.

According to the above constitution, color printer 1 forms a print image on the surface of transfer paper 5BY using the basic color toners (Y1, M1, C1, and K1) each having substantially the same value of the solubility parameter, together with first clear toner CL1 having a different solubility parameter value than that of the basic color toners, such that first clear toner CL1 is adjacent to the basic color toners (Y1, M1, C1, and K1). In color printer 1, first clear toner CL1 accordingly can avoid color blurring due to toner mixing in the boundary between coat layer 5BY of transfer paper 5B and the basic color toners (Y1, M1, C1, and K1) when the basic color toners (Y1, M1, C1, and K1) and first clear toner CL1 adhering to the surface of print medium 5 are melted by heating and pressing. Therefore, color printer 1 can also avoid a deterioration of the image quality of the print image formed on the surface of transfer paper 5B having coat layer 5BY.

(3) Other Embodiments (3-1) First Other Embodiment

In the first and second embodiments described above, basic color toners (yellow toner Y1, magenta toner M1, cyan toner C1, and black toner K1) are produced by the emulsion polymerization method and first clear toner CL1 is produced by the pulverization method. The invention is, however, not limited to these. The basic color toners (Y1, M1, C1, and K1) may be produced by the pulverization method, the dissolution suspension method, or other methods. The first clear toner may be produced by the emulsion polymerization method, the dissolution suspension method, or other methods. The yellow toner Y1, magenta toner M1, cyan toner C1, black toner K1, and first clear toner CL1 may accordingly be produced by other various toner production procedures.

(3-2) Second Other Embodiment

In the first and second embodiments described above, the basic color toners (Y1, M1, C1, and K1), together with first clear toner CL1 as a special color toner, are used for print image formation. The invention is, however, not limited to this, and white toner, which is produced by using, for example, a polyester resin as a base and titanium white as a colorant, may be used as a special color toner instead of first clear toner CL1. In the invention, this constitution can prevent the white toner and the basic color toners (i.e., yellow toner Y1, magenta toner M1, cyan toner C1, and black toner K1) from being mixed with each other in the boundary therebetween, whereby color blurring can be avoided in the boundary when the white toner and the basic color toners are melted on the surface of print medium 5 by heating and pressing. In the invention, the special color toner is not limited to clear toner and white toner, and may be special color toners from mixed colors of two or more basic colors and special colors that cannot be produced from basic colors.

(3-3) Third Other Embodiment

Furthermore, in the first and second embodiments described above, the basic color toners (Y1, M1, C1, and K1) and first clear toner CL1 are produced to have different values of the solubility parameter between the basic toners and first clear toner CL1 by using different resins (i.e., a styrene acrylic resin and a polyester resin) as the base. This avoids color blurring due to the melting of the toners in the boundary between the first clear toner CL1 and the basic color toners (Y1, M1, C1, and K1). The invention is, however, not limited to this. For example, any one of the basic color toners (Y1, M1, C1, and K1) and the other three basic color toners, or any two basic color toners and the other two basic color toners, may be produced to have different values of the solubility parameter by using different resins (i.e., a styrene acrylic resin and a polyester resin, and other resins) as the base. In other words, as long as one or more desired color toners to be prevented from mixing with each other when melted, regardless of the basic color toners and clear toner, may be produced so as to avoid color blurring in the boundary therebetween, color toners in various other combinations may be produced to have different values of the solubility parameter by using a styrene acrylic resin, a polyester resin, or other resins as the base.

In the invention, not only two or more color toners may be produced to have different values of the solubility parameter so as to avoid color blurring in the boundary therebetween, but also these two or more color toners may be produced to have different melting points as the solubility of these toners by changing the type of resin as the base as well as the type of wax as another material. In the invention, this constitution can generate a difference in melting degree between two or more color toners having different melting points when these two or more color toners are melted on the surface of print medium 5 by heating and pressing, whereby these two or more color toners can be prevented from mixing with each other. In the invention, this constitution also can accordingly avoid color blurring in the boundary between these two or more color toners on the surface of print medium 5 in the same manner as in the first and second embodiments described above, thereby preventing a deterioration of the image quality of the print image.

Although a total of five color toners of yellow toner Y1, magenta toner M1, cyan toner C1, black toner K1, and first clear toner CL1 are used for print image formation in the invention, toners used for the print image formation are not limited to these five color toners or to five color toners. That is, when print images are formed on the surface of, for example, plain paper 5A as print medium 5, at least two or more color toners (i.e., basic color toners and special color toners) can be used in various combinations in such a manner that only two color toners are used for print image formation, as long as color blurring can be avoided in the boundary between the different desired toners (i.e., basic color toners and special color toners) in the print image in the invention.

In the invention, when the print image is formed on the surface of, for example, transfer paper 5B as print medium 5, one or more basic color toners may be produced to have values of the solubility parameter different from that of coat layer 5BY of transfer paper 5B by 6.1 $(cal/cm^2)^{1/2}$ or more. In the invention, this constitution can avoid color blurring in the boundary between the basic color toners and coat layer 5BY of transfer paper 5B even when the print image is formed on the surface of transfer paper 5B using only the basic color toners without using the first clear toner CL1. In this print image formation on the surface of transfer paper 5B as print medium 5, at least one or more color toners can thus be used for print image formation in such a manner that only one color toner (i.e., a basic color toner or a special color toner) is used for the print image formation, as long as color blurring can be avoided in the boundary between coat layer 5BY of transfer paper 5B and the basic color toner or special color toner in the print image in the invention.

(3-4) Fourth Other Embodiment

Furthermore, in the first and second embodiments described above, the image formation apparatus according to the invention is described which can be applied to color printer 1 described above with reference to FIGS. 1 to 17.

The invention is, however, not limited to this and can be widely applied to other image formation apparatuses with various configurations, such as primary transfer-type color printers involving directly transferring toner images formed with image formation units to the surface of print medium 5, monochrome electrophotographic printers, multifunction printers, facsimiles, and complex machines.

(3-5) Fifth Other Embodiment

Furthermore, in the first and second embodiments described above, print media 5 such as plain paper 5A and transfer paper 5B described above with reference to FIGS. 1 to 17 are used as the print media on which a first material is transferred to a first position. The invention is, however, not limited to these, and various other print media can be widely used, such as photographic printing paper, postcards, and disk-like record media.

(3-6) Sixth Other Embodiment

Furthermore, in the first and second embodiments described above, the basic color toners (Y1, M1, C1, and K1) described above with reference to FIGS. 1 to 17, and coat layer 5BY of polyester resin of transfer paper 5B are used as the first material in the first position of the print medium. The invention is, however, not limited to these, and various other first materials can be widely used, such as toners of clear, white, and other colors different from yellow, magenta, cyan, and black, which toners are produced using various resins, such as a styrene acrylic resin or a polyester resin as the base, and coat layer 5BY provided on transfer paper 5B and produced using at least resin.

(3-7) Seventh Other Embodiment

Furthermore, in the first and second embodiments described above, first clear toner CL1 described above with reference to FIGS. 1 to 17 is used as a second material with different solubility from that of the first material, which second material is transferred to a second position on the print medium where the second material comes into contact with the first material in the first position on the print medium. The invention is, however, not limited to this. Various other second materials can be widely used, such as various color toners, such as basic color toners (Y1, M1, C1, and K1) produced using various resins, such as a styrene acrylic resin or a polyester resin, as the base.

(3-8) Eighth Other Embodiment

Furthermore, in the first and second embodiments described above, transfer unit 15 of color printer 1 described above with reference to FIGS. 1 to 17 is used as a transfer unit configured to transfer the second material, with a different solubility from that of the first material, to the second position on the print medium where the second material comes into contact with the first material in the first position on the print medium. The invention is, however, not limited to this, and other transfer units with various configurations can be widely used, such as primary transfer-type transfer units involving directly transferring toner images from the image formation units to the surface of the print medium.

(3-9) Ninth Other Embodiment

Furthermore, in the first and second embodiments described above, fixation unit 16 described above with reference to FIGS. 1 to 17 is used as a fixation unit configured to melt the second material transferred to the second position of the print medium and fix it to the print medium. The invention is, however, not limited to this, and other fixation units with various configurations can be widely used, such as fixation units having press roller 87 with an internal heat generator, and fixation units having a rotatable endless belt instead of at least one of heat roller 86 and press roller 87.

(3-10) Tenth Other Embodiment

Furthermore, in the first and second embodiments described above, coat layer 5BY being a polyurethane resin layer of transfer paper 5B described above with reference to FIGS. 1 to 17 is used as a coat layer provided on the print medium. The invention is, however, not limited to this. Other coat layers with various constitutions can be widely used, such as coat layers that are provided on print media, such as transfer paper 5B, and produced to have a melting point different from that of toners by using various resins, such as a polyester resin, a styrene acrylic resin, and a polyester resin, as the base, together with wax and the like as other materials.

INDUSTRIAL APPLICABILITY

The invention can be used with an image formation apparatus, such as color electrophotographic printers, monochrome electrophotographic printers, multifunction printers, facsimiles, and complex machines.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

a transfer unit provided along a medium conveyance path through which a print medium is to be conveyed and configured to transfer, on the print medium, a first material and a second material with different solubility from that of the first material such that the second material is provided, on the print medium, at outside of an outline of an area where the first material is provided on the print medium and in contact with the outline of the area while the second material is not provided on or above the first material provided on the print medium; and a fixation unit provided downstream of the transfer unit along the medium conveyance path and configured to melt the first material and the second material transferred to the print medium and thereby fix the first material and the second material to the print medium.

2. The image formation apparatus according to claim 1, wherein the second material has a value of solubility parameter different from that of the first material by 6.1 $(cal/cm^3)^{1/2}$ or more, the solubility parameter indicating solubility.

3. The image formation apparatus according to claim 1, wherein the fixation unit is configured to melt the second material on the print medium by heating at a temperature ranging from 160° C. to 200° C. and pressing at a pressure ranging from 2.0 $kg/cm^2$ to 3.0 $kg/cm^2$.

4. The image formation apparatus according to claim 1, wherein the transfer unit is configured to transfer a first developer as the first material and transfer a second developer as the second material on the print medium.

5. The image formation apparatus according to claim 1, wherein the transfer unit is configured to transfer a first developer produced using a colorant as the first material and transfer a second developer as the second material on the print medium.

6. The image formation apparatus according to claim 1, wherein the transfer unit is configured to transfer a first developer produced using a colorant as the first material and transfer a second developer produced without using a colorant as the second material on the print medium.

7. The image formation apparatus according to claim 1, wherein the transfer unit transfers a first developer produced using one of styrene acrylic resin and polyester resin as the first material and transfers a second developer produced using the other of the styrene acrylic resin and the polyester resin as the second material on the print medium.

8. The image formation apparatus according to claim 1, wherein the first material is produced using one of styrene acrylic resin and polyester resin, and the second material is produced using the other of the styrene acrylic resin and the polyester resin.

* * * * *